US008042242B2

(12) United States Patent
Maugans et al.

(10) Patent No.: US 8,042,242 B2
(45) Date of Patent: Oct. 25, 2011

(54) MECHANICAL DEVICE FOR SPREADING FLANGES APART

(76) Inventors: Rexford Allison Maugans, Lake Jackson, TX (US); John Smircic, Richwood, TX (US)

( * ) Notice: Subject to any disclaimer, the term of this patent is extended or adjusted under 35 U.S.C. 154(b) by 456 days.

(21) Appl. No.: 12/381,426

(22) Filed: Mar. 13, 2009

(65) Prior Publication Data

US 2010/0229362 A1 Sep. 16, 2010

(51) Int. Cl.
*B23P 19/04* (2006.01)

(52) U.S. Cl. ..... 29/239; 29/257; 29/253; 29/270; 29/276

(58) Field of Classification Search ..... 29/239, 29/238, 244, 253, 266, 267, 270, 271, 276, 29/278

See application file for complete search history.

(56) References Cited

U.S. PATENT DOCUMENTS

| | | | | |
|---|---|---|---|---|
| 3,022 | A | 3/1843 | Latta | |
| 98,656 | A | 1/1870 | Adt | |
| 42,222 | A | 4/1884 | Perrin | |
| 1,433,617 | A | 10/1922 | Hoffman | |
| 1,721,964 | A | 7/1929 | McAleenan | |
| 1,882,297 | A | 10/1932 | Payne | |
| 2,525,625 | A | 10/1950 | Stott | |
| 2,642,905 | A | 6/1953 | Hewat | |
| 2,687,162 | A | 8/1954 | Smith | |
| 6,000,686 | A * | 12/1999 | Yates | 269/6 |
| 6,032,939 | A * | 3/2000 | Chen | 269/249 |
| 6,209,427 | B1 | 4/2001 | Healy | |
| 7,004,682 | B1 * | 2/2006 | Moody | 405/184.4 |
| 2008/0048375 | A1 * | 2/2008 | Rolfe et al. | 269/249 |
| 2010/0229362 | A1 * | 9/2010 | Maugans et al. | 29/239 |

* cited by examiner

*Primary Examiner* — Lee D Wilson

(57) ABSTRACT

The device is based on using a thrust bolt in a modified C-clamp design to push a pressure plate to pry apart two intersecting flanges of a profile. The device is primarily used for on-boat repairing of aluminum extrusion profile boat toe rails that have segments of their vertical flanges crushed inward. It has utility for bending any flanges apart that are greater than 20 and less than 160 degrees apart to start with. It has utility for bending flanges apart that are made from any material, such as metal, that has an elastic limit and enough plastic flow to permanently bend without rupture.

16 Claims, 7 Drawing Sheets

FIG. 3
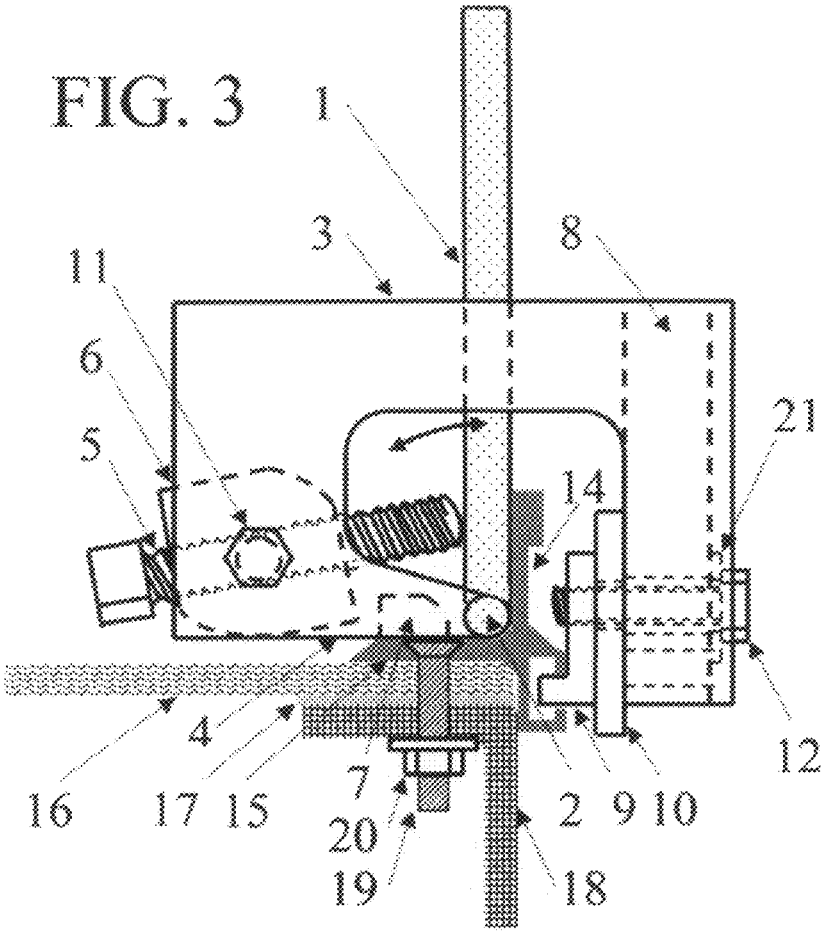
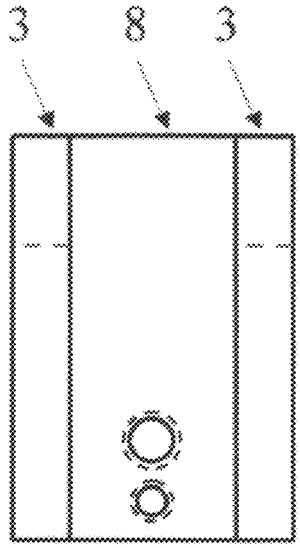
FIG. 4
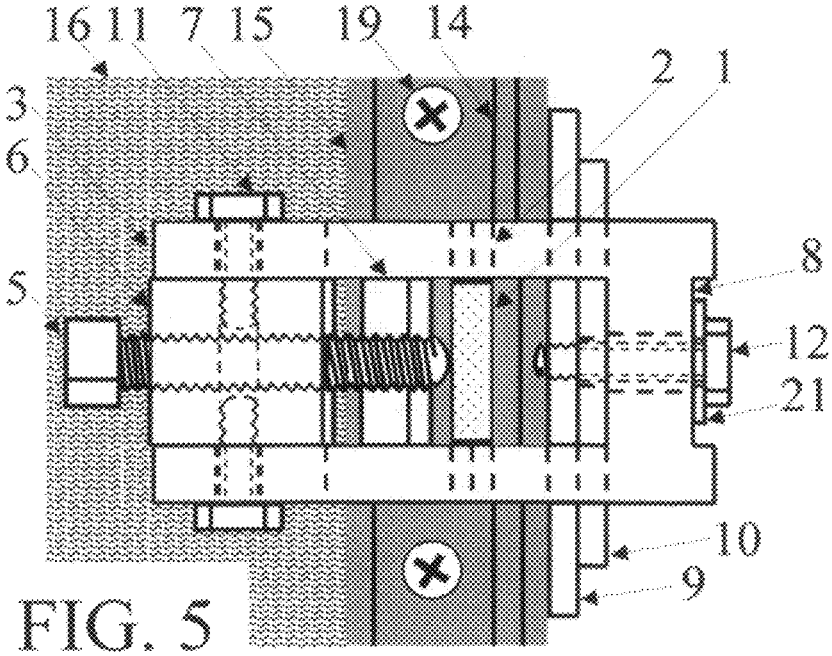
FIG. 5

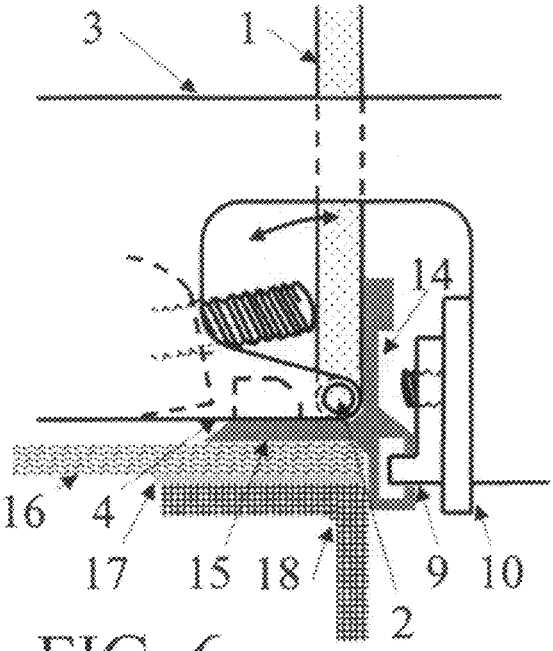
FIG. 6 CAPTURED PIVOT WING
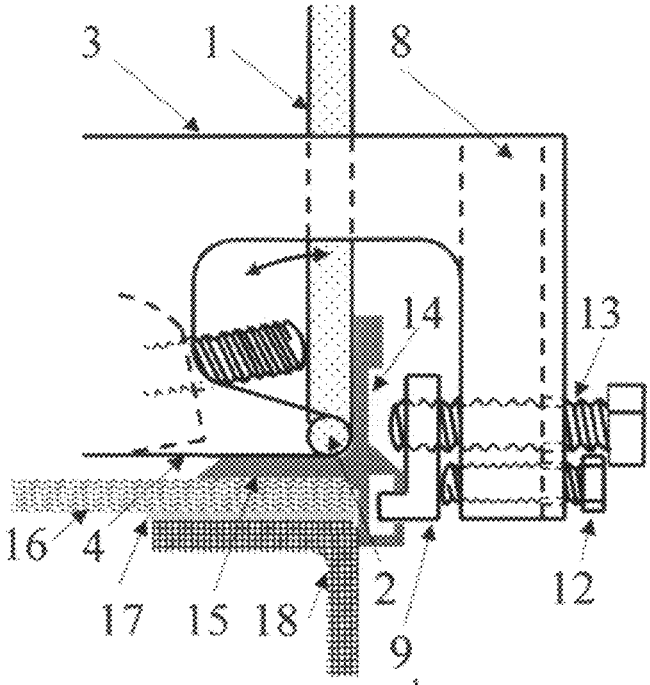
FIG. 7 2nd HOOK METHOD
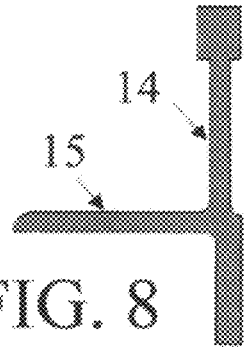
FIG. 8 2nd TOE RAIL PROFILE

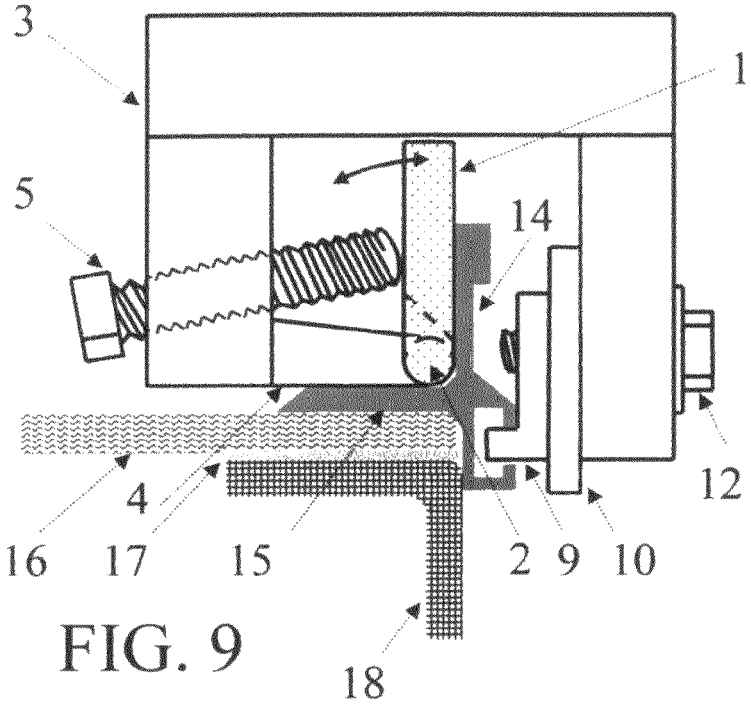
FIG. 9
FIG. 10
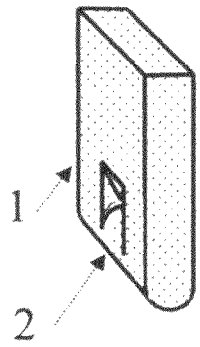
STRADDLING PRESSURE PLATE
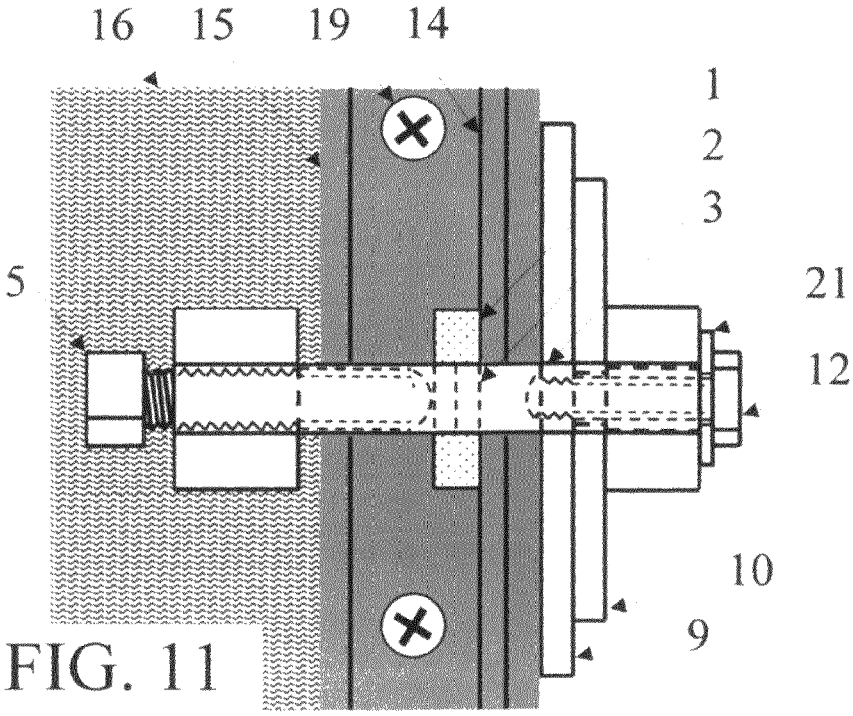
FIG. 11

FIG. 12
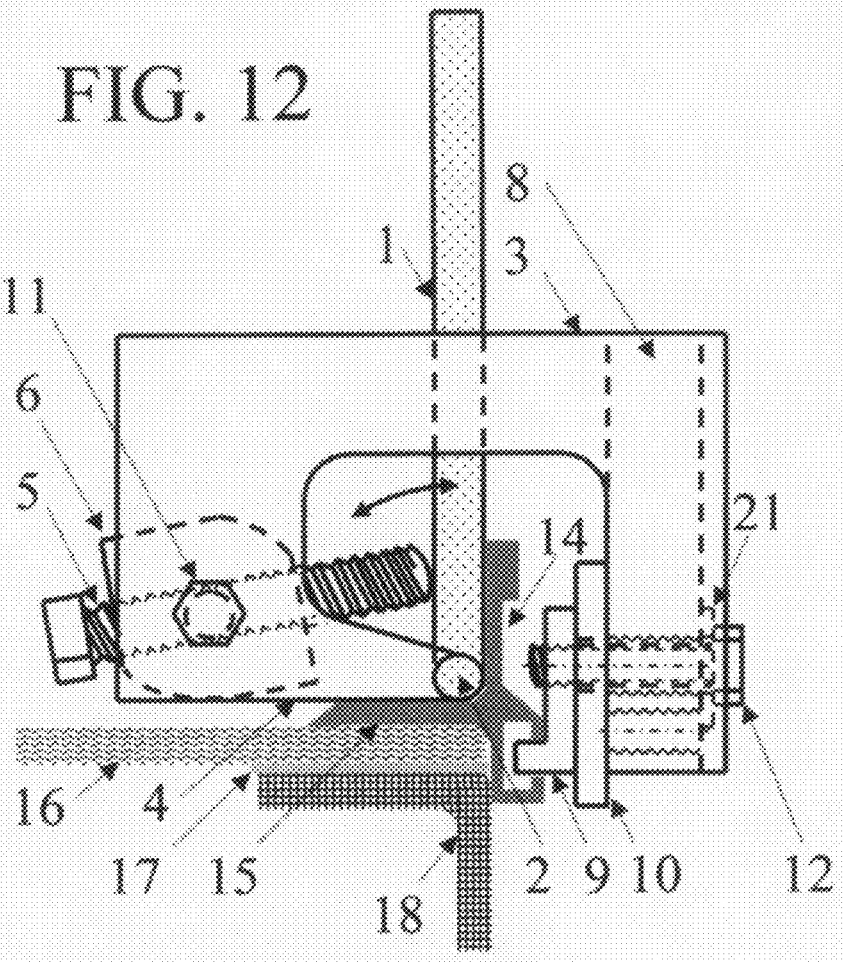
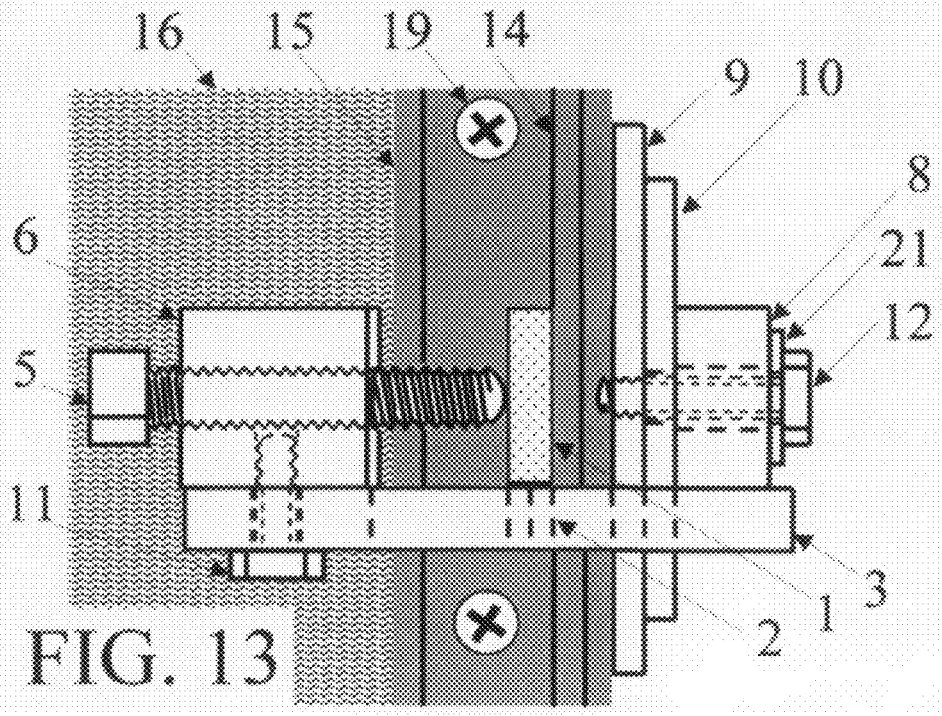
FIG. 13

MECHANICAL DEVICE FOR SPREADING FLANGES APART

CROSS REFERENCE TO RELATED DOCUMENTS

None

STATEMENT REGARDING FEDERALLY SPONSORED RESEARCH OR DEVELOPMENT

None

REFERENCE TO SEQUENTIAL LISTING, A TABLE, OR A COMPACT DISC APPENDIX

No appendix. A table is included in the text of the Detailed Description of the Invention.

FIELD OF THE INVENTION

This invention relates to mechanical devices to pry apart flanges of profile extrusions. It is a metal bending modification of a C-clamp concept.

BACKGROUND OF THE INVENTION

Many fiberglass boats are constructed by attaching two main moldings, the hull 18 and the deck 16 as shown in FIG. 16. The deck molding is often attached to a lip around the top edge of the hull molding. A plate 15 on top of the edge of the deck is often used as the top of a three piece structure: plate, deck and lip of the hull. This structure is often connected with bolts 19 and nuts 20, or such fasteners, that are often four or six inches apart around the edge of the deck piece 16.

The plate 15, described above, is often part of an aluminum extrusion profile that is in the shape of a modified 'L' or 'T', that is lying on its side. The horizontal surface serves as the connecting plate 15, above. The vertical surface is called a toe rail 14 and serves to help prevent objects, including people, from sliding off the boat deck 16 and into the water. NOTE: the term 'toe rail' is used somewhat interchangeably in boating to sometimes define the vertical flange 14 and sometime to define the aluminum profile extrusion that comprises the vertical flange 14 at the edge of a boat deck 16.

Fenders are often the edge of an automobile and as such are often damage points. A toe rail is often the edge of a boat, and as such is often damaged when contact is made with things like pilings, when the boat is heeled (canted), like in a storm wind.

The damage is often in the form of segments of toe rails 14 that are bent inward towards the center of the boat as shown in FIG. 17. Toe rails 14 are continuous pieces so the amount of bending varies along the length of the damage from the deepest damage point out to where the rails are still straight. The damaged segments can be from a few inches to several feet long. Toe rail damage is rarely more than 45 degrees of inward bending. Aluminum toe rail extrusions often have a vertical flange 14 that is thicker at the lip than at the base. The bending damage is usually at that base, near the flange root, where the bending stresses are the greatest and where the wall thickness is the lowest.

Repair requires replacement of the aluminum extrusion profile or spreading the vertical flange 14 (the toe tail), FIG. 17, back away from the horizontal flange 15 (the hull/deck connection plate). The replacement option is exceedingly laborious as much permanently installed interior often has to be removed to get to the interior side of the connections, such as the bolt nuts 20. The interior includes items such as headliners (ceilings) and cabinetry. The replacement option is further complicated with older boats and 'out of business' boat builders and/or profile providers.

Pounding the vertical toe rail 14 back into a straight position is sometimes done and sometimes successfully. The strength of the aluminum profile extrusions makes it difficult to apply enough pounding impact to straighten the profiles, much less do so in a controlled manner. Control is important because the continuous profiles make it difficult to isolate repairs. Pushing one flange location also affects adjacent portions of the profile. The pounding action also puts impact tensile stress (prying force) on the hull-deck connection and may cause damage to this critical connection. The major problem with the pounding approach is that the repair can be readily seen. Damage to hull-deck connections and seals 17 can not be so readily seen until leaks enter the boat or major hull-deck separation occurs in a storm.

The pounding action also has potential for warping a toe rail 14, lip to root, while it is being straightened along its length down the boat. Using a piece of 2×4 to spread out the pounding still puts prying stress on the horizontal flange 15 and still has warpage potential. But as mentioned above, it sometimes works, insofar as what can be seen.

A prying action to straighten the toe rail flange 14 has the same problem as pounding the toe rail 14, in that the prying action also puts prying stress on the deck plate flange 15 and its hull-deck connection. The potential for damaging hull-deck connections and seals 17 is the same as described above.

Boat toe rail aluminum extrusions often have vertical flanges 14 that are near, or less than, two inches high. The thickness of the root of the vertical flanges 14 is generally ⅛ to ¼ inch thick. The flange fillets are usually in the range of 3⁄16 inch radii.

There are a range of different boat toe rail profile geometries. This influences where a hooking action is needed on the outside of the profile, the side on the outside of the hull.

Some of the profile geometries have relatively delicate surfaces where hooking action would occur. For example, a SAGA 43 sailboat uses a profile (dark area in FIG. 16) with an open rectangular slot for insertion of a rubber rub rail (bumper). There is a 3⁄32 inch thick aluminum part to that slot that could be damaged by excessive local compression from a C-clamp device at that point.

The fiberglass deck surfaces 16 under the toe rail extrusion profiles, the hull-deck connector flange 15, are easily gouged by metal bolt heads or bolt turning tools. Easily gouged, if trust bolt 5 lengths, geometries and/or thrust angles cause bolt head or tool interfere with such fiberglass.

Repair equipment can be designed with engineering principles, but such calculations are exceedingly laborious, if possible, for some applications. For example the many different profile shapes for boats' aluminum toe rail extrusions would require significant calculations for what stresses to direct and where for each repair application. The almost infinite variability of crushing damage further complicates the ability to use calculations alone to design precise repair equipment. Force and stress calculation difficulties are further exacerbated by the unknown effect of the portions of the continuous profiles that extend beyond the sides of a straightening device or action. The profiles are often designed with thickened lips to reinforce the profiles, which add yet more to the stress prediction complications.

The normal procedure of overdesign to accommodate uncertainties is complicated by the small geometry available inside tight angles between crushed flanges.

Archimedes, a Greek engineer, described screwing circa 1250 B.C.

A screwing action is described in a C-clamp device by Perrin's April 1864 U.S. Pat. No. 42,222. Perrin's device is used to press planking into place for wooden boat construction. It has a 'C' plate to permit the device to reach around the object being pressed. The pressing, or pressing together, action of Perrin's device is a common characteristic of C-clamps. The small pressure pad at the end of the thrust bolt is in common usage for C-clamps and distributes the load enough to avoid damaging the surface of the piece being acted upon. However the pressure pad does not distribute the force enough to control deformation of the piece being acted upon. The location of the piece's deformation(s) is instead controlled by the geometry of the piece and/or the geometry of whatever the piece is being forced against. For example, the piece being deflected in Perrin's illustration shows wooden ship planking that is warping under clamping stress, as would be expected, as it is bent around a frame, versus being bent as a straight piece.

Perrin's C-clamp has adjustable hooking action to accommodate variations in the geometry of the boats' ribs. The adjustable nature of the hooking action is somewhat unusual as most C-clamp hooking action is another simple contact pad that again distributes the load just enough to avoid damage to the surface being contacted as illustrated in Adt's January 1870 U.S. Pat. No. 98,656.

A more linear hooking action is described in Payne's October 1932 U.S. Pat. No. 1,882,297. However Payne's device has two problems for repairing bent toe rails. One: if it is used to grip the end of a flange, it would have the same deformation situation as described above for Perrin's U.S. Pat. No. 42,222. The piece being straightened would still be subject to warping from root to lip while the lip was being pulled away from the other flange.

Payne's device has an offset design that can impart a twisting/straightening force. Payne described a use of the device for straightening door frames. One could also visualize using this design for prying flanges apart if one of the flanges were secured to something else. However, Payne's device's second problem is that such prying action would also put prying stress on the secured flange. In the case of a boat's hull-deck connecting plate 15, such prying stress may damage that securing connection, as discussed earlier.

Hoffman's October 1922 U.S. Pat. No. 1,433,617 describes a hanger support (clamp) on a flange. It could be modified with pressure plates, versus the pressure points in Hoffman's patent description, and could be used to straighten a flange. The other parts of the profile would have to be secured to something substantial. Again, the approach would provide problems for boat toe rail repairs because of the collateral transfer of the prying stresses to the deck flange 15.

Pivoting beams or plates are commonly used to bend metal into flanges. Latta's March 1843 U.S. Pat. No. 3,022 described the use of pivoted bending pieces to force a flat plate into a U shape for steamboat water-wheel stirrups.

Smith's August 1954 U.S. Pat. No. 2,687,162 describes several useful concepts that aid the design of metal bending equipment. He utilizes a bolt driven pivoting block or pressure plate to force the piece being bent around a die that fits the corner of the piece being bent. The plate negates some of the flange warping problems, described above under the discussion about Perrin's U.S. Pat. No. 42,222. The pivoting action negates more of the warping concern. A pressure plate that only contacts the lip of the flange has the same warping problems described above under the discussion about Payne's U.S. Pat. No. 1,882,297. Whereas the pivoting plate in Smith's device description supports the entire piece to be bent, as it is bent around a pivot point. Smith describes C-shaped side walls or dual 'C' plates. The dual structure provides a convenient location for mounting a pivoting housing unit for a thrust bolt. He secures the 'C' plates with a combination of welded cross pieces and a pivoting piece.

Stott's October 1950 U.S. Pat. No. 2,525,625 for bending metal uses a rotating clamp that secures the metal between plates as the metal is bent to form a flange. Such a device also avoids lip to root warpage as the metal is bent to form a flange.

Latta's, Smith's and Stott's patents all describe how to create flanges from flat stock. In all three cases the base materials/stock is bent with compressive bending forces from outside the flanges being formed. Likewise the backing forces against the bending compression are outside the flanges being formed. However, prying flanges apart requires bracing in the opposite direction, and against prying forces versus against compressive, forces. While there are some overlapping mechanical concepts, prying flange faces apart versus pressing flange faces toward each other presents a different set of needs than the three inventions, above, were created to address. All three inventions have limitations to straighten bent flanges back apart, especially with on-board repairs of bent-in boat toe rails.

Prying flanges apart, like in a repair operation, requires the bending force be able to get inside between the flanges. The three flange forming inventions above, designed for flange manufacture, have the bending force applied from the opposite direction, outside the flanges. There is little interior space available at the intersection of two flanges that have been crushed together, versus the space available to produce flanges from flat stock. The descriptions in the three flange forming inventions, above, make it difficult to visualize how they would get pivoting thrust plates into tight flange intersections.

If one also has to get the opposing backing force into those intersections of bent together flanges, then the geometry problem of using the three flange manufacturing methods, above, become even more difficult to visualize as a method to repair bent-together flanges.

One could visualize avoiding the need for a backing force inside the flanges by using a secured flange as the opposing backing force for a bent flange repair. In the case of a boat toe rail the unmoving flange 15 can be the deck plate/flange 15 used to secure (and seal 17) the fiberglass deck 16 to the fiberglass hull 18. However the prying stresses will also apply to the securing system used to secure the unmoving flange 15 to the other structure. Serious prying stresses are to be avoided with these connections as such stresses may damage critical hull-deck connections/seals.

The prying action to repair bent flanges also has to face the problem described earlier of prevention of the opposing forces from pushing the device out of the flange intersection versus forcing the flanges back apart. The need for a hooking action opposite of the flange intersection was described earlier. The concept of multiple connection/pressure points is illustrated in Hewat's June 1953 U.S. Pat. No. 2,642,905. He grips an item with compression at two ends and then has a pivoting thrust bolt available for further metal clamping or moving. This invention does not lend itself to prying a boat's bent toe rail flange 14 back from the toe rail's deck plate 15. Deck plates 15 are often chamfered or rounded at their ends, FIGS. 16 and 8. The deck plate 15 is left with no place to attach a compression clamp at its outer end that squeezes into the plane of the plate 15. This also creates problems with using the preceding three flange manufacturing inventions, if their application was attempted for repair of crushed-in flanges.

McAleenan's July 1929 U.S. Pat. No. 1,721,964 describes a machine to adjust the shape of profiles. The invention describes putting a 'T' shaped profile beam into a dual biaxial press and retaining the 'T' shape while forming a longitudinal contour around a vertical axis. A flat die comes down and protects the top of the 'T' from deforming as a die is moved horizontally against a facing static die. The system depends on the ability to have dies and backing dies in two planes. This is a reasonable concept for manufacturing curved profiles of the same design from straight beams.

One could visualize how McAleenan's concept could be used to straighten bent flanges as the closing of the dies would force the flanges into straight positions. The first problem with using McAleenan's double die concept for bent boat toe rail repair is the definition of straight. Two straight dies coming together will not necessarily produce a straight flange 14 like in FIG. 16. A bent flange 14, like in FIG. 17, has to be overstraightened enough past its yield point to elastically recover to a straight position. The random bending amount of damaged toe rails and the variability of toe rail profiles conspire to make it exceedingly difficult to calculate the necessary angle offsets for die designs. The calculations are further complicated by how straight/curved the dies have to be from root to flange tip to ensure the final straight die is not warped in the process.

One could use shims to achieve the necessary overbending beyond the yield points. For a repair operation, a shim approach substitutes a repetitive, laborious cut and fit activity for 'some' of the angle calculations. The repetitive shim cutting, flange bending, recutting and rebending, etc. pushes costs and quality.

However, a second, bigger problem with McAleenan's dual axis, dual die system is the collection of geometry problems to apply such a system to an on-board boat toe rail that has to be straightened. A horizontally moving die to straighten a toe rail flange 14 would have to have some opposing force behind it and attached to the profile. Otherwise, the moving horizontal die would just be another lever action with its attendant problems, as described above in the discussion of Payne's U.S. Pat. No. 1,882,297. But as discussed above with Hewat's U.S. Pat. No. 2,642,905, there is rarely a reasonable place on boats' toe rails to apply such an opposing force behind the horizontally moving straightening die.

If the horizontally opposing force is moved to the opposite side of the profile, behind the profile and opposite to the deck flange 15, the horizontal die becomes a prying lever that also applies undesirable collateral prying force to the deck plate/flange 15.

But McAleenan's concept could be applied in part by compressing a bent toe rail between two beams, using just a horizontal axis of compression against a bent toe rail and no constraining vertical forces. The double die/beam procedure would apply some prying forces to deck plate 15 areas on the damaged toe rail 15 sections that would be matched by compression forces on the deck plate 15 areas of adjoining undamaged segments.

The bigger issue with the dual die single axis approach is that it has more potential for averaging the bend angle along a length of the toe rail extrusion that straightening per se. Specifically, for the dual die approach to be successful the compression beams have to be long enough that the resultant average bend angle would have the damaged sections near their original right angle. This would necessitate long, strong beams of the exact horizontal curvature of the boat and with the right amount of overstraightening built in at the right places. Such custom made die beams would require even more effort and expense that the laborious task of just replacing the toe rails.

One of the repair techniques in practice today for straightening bent toe rails is to accommodate hull curvature by using straight and shorter versions of the double die/beam concept above, sometimes with a shimming action included. The repair results require skill and often still end up 'good nuff' in the eyes of the repairman as the bend damage is 'averaged' out more than it was initially, maybe to the satisfaction of the boat owner, maybe not.

There are devices that are designed to pry items apart. Healy's April 2001 U.S. Pat. No. 6,209,427 B1 describes a device for prying open parts of an automobile suspension. The device depends on the ability to push items apart that are roughly parallel to each other. That is not the case with intersecting reasonably straight flanges that are bent towards each other like boats' bent toe rails. Application of prying force in Healy's device would tend to force the device out from between the flanges versus forcing them apart.

Clamps on the ends of Healy's prying surface might work with intersecting flanges if they were strong enough. However, the end of a boat toe rail profile deck plate 15 has no way to attach such a clamp, while the profile is attached to the boat 16.

Incorporate all references in their entirety.

SUMMARY OF THE INVENTION

The invention is especially suited to straightening crushed-in toe rails along the contours of boats' hull-deck connections 14, FIG. 2. The invention comprises a novel combination of a pivoting pressure plate 1 between the flanges 14 and 15 being separated, a pivot point at the flanges' intersection, an opposing die 4 between the flanges, and a hooking action 9 to prevent the pressure plate 1 and/or the opposing die 4 from popping out from between the flanges 14 and 15.

The invention provides the corrective bending without collateral damage to supporting structures, such as hull-deck, 18-16, connections and seals 17. It also does so without warping the flanges 14, root to lip. The invention's 'C' plate hooking action 9 prevents the prying action from popping the device out from between the intersecting flanges, 14 and 15. Its novel combination and assembly of features provides a design that lends itself well to the precise application of exactly the right amount of corrective bending, prying apart, of boat toe rail profiles, 14 and 15 in FIGS. 7 and 8, on the variety of profile types and on the variety of damage that are faced in boat repairs.

The tight geometry, inside crushed intersecting flanges, prevents insertion of the manufacturing equipment commonly used to produce flanged material by bending flat stock from outside the flanges. Instead, this invention's novel approach is to have a pivoting thrust bolt 5, a pivoting pressure plate 1 and a backing force 'C' plate extension 4 all positioned inside the flanges 14 and 15, to be pried apart. To prevent flange warping, root to lip, the pressure plate 1 pivots at the intersection of the flanges 14 and 15.

Such positioning put geometry and strength limitations on the device. Experimentation surprisingly found novel geometry and dimensions that could get critical components into flanges' intersections and still be strong enough to provide the needed prying forces.

The experimental results were applied to produce a table that can use the invention's principles to design specific device geometry for various intersecting flanges' prying applications. Specifically, the invention has application to any flange separation need if the flange material has the necessary elastic limit and plastic flow to permanently bend without rupturing.

Materials have elastic limits that must be exceeded before permanent changes can be made in their dimensions. For example, a boat's damaged aluminum toe rail flange 14 has to be overstraightened slightly to be repaired to a right angle position. This invention gives an operator the novel flexibility to adjust a thrust bolt 5 to move the pressure plate 1 the exact amount needed to precisely repair a specific damaged portion of a flange.

The invention, described in FIGS. 1 thru 7 and 9 thru 15, is a mechanical device to pry apart two intersecting flanges (A and B), 14 and 15, with lips, root thicknesses and with a fillet radius, in a profile, the device comprising:

- at least one 'C' plate 3 to surround one of the flanges (A) 14, with
- a hooking action 9 behind flange (A) 14,
- a thrust bolt 5 mounted opposite the hooking action,
- an extension 4 of the 'C' clamp structure 3 that extends below the thrust bolt 5 and
- a pressure plate 1, with a thickness, that pivots in the flange intersection to pry one flange (A) 14 apart from the flange (B) 15 under the extension(s) 4 when thrust bolt 5 force is applied to the pressure plate 1.

The invention is a mechanical device to pry apart two intersecting flanges, 14 and 15, in a profile, the device comprising:

- a thrust bolt 5 that pries one flange (A) 14 apart from a flange (B) 15, both flanges having inside faces facing each other,
- has a backing die 4 against the inside face of flange (B) 15 and
- another backing action 9 behind the profile structure and across from flange (A) 14.

The preferred invention method is with profile flanges, 14 and 15, that are initially 20 to 160 degrees apart.

The invention is useful where the flanges, 14 and 15, being pried apart, comprise part of an aluminum toe rail profile for a boat, FIG. 2.

The preferred invention design is where at least one wing 2 at the bottom of the pressure plate 1 is captured by at least one slot in the end of the 'C' plate extension(s) 4, FIGS. 3, 9 and 12.

Another, less preferred, method for the invention is a design, FIG. 6, where the 'C' plate(s) extension(s) 4 have ends that fit into the intersection of the extrusion profile flanges, 14 and 15, and such ends have holes to capture the wings 2, or bottom cylinder, FIG. 10, of the pressure plate. The slot design, described in the previous paragraph, is preferred because it was discovered that when a thrust bolt 5 puts thrust between the lip and root of the flange 14, the base of the pressure plate 1 seats itself at the flange's fillet, intersection. This reduces the precision need of the fit of the device to the profile.

To provide necessary strength it is preferred to have a pressure plate 1 with a thickness that is equal or greater than the thickness of the root of the flange 14 to be pried apart.

To optimize strength and minimize warpage potential 14 it is preferred to have a pressure plate 1 that has a thickness that is equal to 1.1 times the thickness of the root of the flange 14 to be pried apart or two to four times the radius of the filet at the intersection of the flanges, 14 and 15, to be pried apart, whichever is larger.

To get the device into tight flanges', 14 and 15, intersections it is preferred to have 'C' plate extension(s) 4 taper down to a height that is the same as the pressure plate 1 thickness.

To get good die backing action it is preferred to have the 'C' plate(s) extension(s) 4 extend up to the root of the flange (A) 14 to within a distance no more than quadruple the flanges' (A and B), 14 and 15, fillet radius.

It is preferred that the device design be comprised of two 'C' plates 3 and a pressure plate 1 that fits between them as described in FIGS. 3, 4 and 5. This facilitates the balance of stresses within the device.

Although not preferred the device can be comprised of a single 'C' plate 3 and a pressure plate 1 that straddles the 'C' plate 3 as shown in FIGS. 9, 10 and 11.

Although not preferred the device can be comprised of a single 'C' plate 3 and a pressure plate 1 that is alongside the 'C' plate 3 as shown in FIGS. 12 and 13.

As described above, when the thrust bolt 5 can provide thrust alignment inside the lip of a flange (A) 14 that has been bent out of position, as shown in FIG. 2, such thrust alignment helps position the pressure plate 1 in the flanges' fillet, intersection, 14 and 15.

It is preferred that the thrust bolt 5 be in a housing 6, FIGS. 3 and 5, that is a pivoting piece to allow different thrust angles against the pressure plate 1.

An hydraulically driven rod 22, FIG. 14, can be substituted for a thrust bolt to provide additional thrust when needed.

A pneumatically driven rod 22, FIG. 14, can be substituted for a thrust bolt to provide additional thrust when needed.

Although not preferred, a lever driven rod 22 can be substituted for the thrust bolt as shown in FIG. 15.

It is preferred to have a hooking action 9 behind flange (A) 14 that can be easily modified with adjustable and/or replacement spacer 10 and/or hook plates 9 to avoid profile damage and to allow for different profile geometries.

Another design option is have the hooking action 9 behind flange (A) 14 be tightened by at least one bolt as described in FIG. 7.

DESCRIPTION OF THE DRAWINGS

FIGS. 3, 4 and 5 are side, end and top views that describe how the parts of the invention fit together and how a boat's deck 16 is connected to its hull 18.

FIG. 4 illustrates the threaded holes in the 'C' plate connector 8 that allows use of the two Hooking Assembly Methods shown in FIGS. 3 and 7.

FIG. 6 shows a second 'C' plate extension 4 design.

FIG. 7 describes a second method of using a hook plate 9.

FIG. 8 shows a second, different and larger toe rail profile that was straightened in Example/experiment 2, FIG. 3. Part 14 is the portion that was straightened in both cases.

FIGS. 9, 10 and 11 show how the invention can be applied to a single 'C' plate with a straddling pressure plate. FIG. 9 is a side view. FIG. 10 is a perspective of a straddling pressure plate FIG. 11 is a top view.

FIGS. 12 and 13 show how the invention can be applied to a single 'C' plate with a side mounted pressure plate.

DETAILED DESCRIPTION OF THE INVENTION

Figure 1:
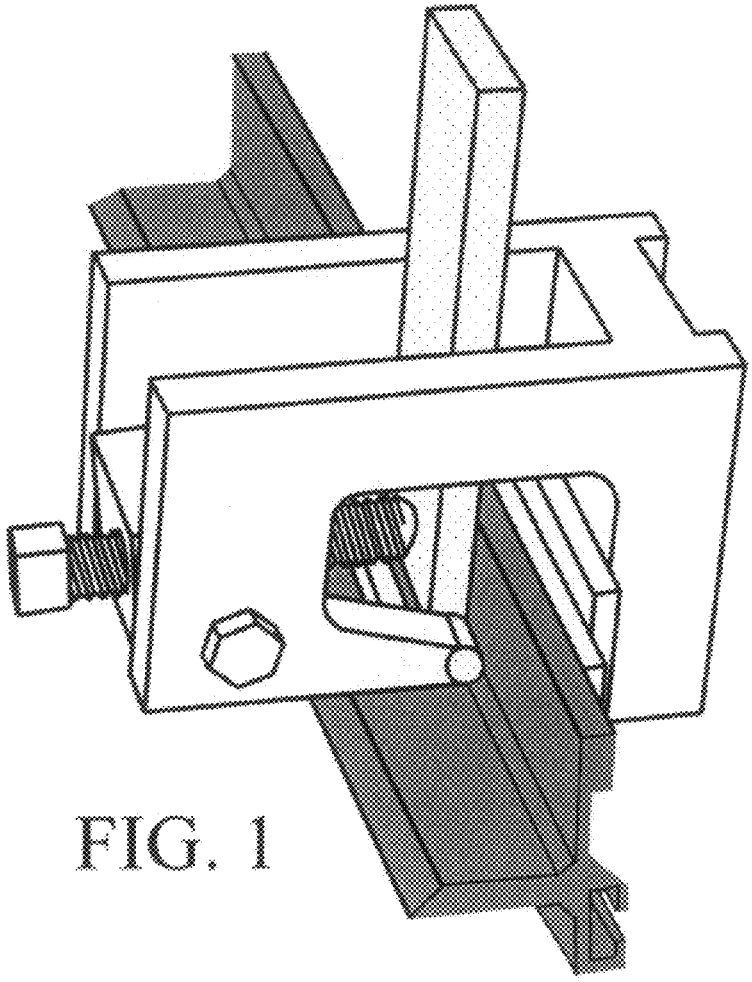
FIG. 1 is a perspective of the invention showing the device attached to boat's toe rail profile.

The contradiction of strength to bend flanges and the geometry of getting a pivot point into a tight flange intersection put contradictory dimension design limitations on the device. Standard engineering formula show the force necessary to bend the flange increases by the cube of the flange thickness. This means the force needed for bending/straightening rises dramatically with flange thickness increase. The high force needed to bend the toe rail 14 put lower size limits on some design criteria. E.g. the pressure plate 1 has to be thick enough to bend/straighten the toe rail 14. The extrusion fillet size between the toe rail flanges, 14 and 15, put upper size limits on some of the same design criteria. E.g., the pressure plate 1 base has to be thin enough to fit the flanges intersection.

The continuous flanges of an extrusion profile extend beyond the edges of the pressure plate 1 and add to the resistance of bending the flange 14 with a pressure plate 1. In the case of boat toe rails the flange lip of the vertical toe rail 14 is strengthened, thickened, which adds even more to the uncertainty of how much force is needed pry the extrusion flanges, 14 and 15, apart. These features add to the design difficulties, described above. However, experimentation, as shown in Examples 1 and 2, surprisingly found the concept, geometry, components and dimensions that worked.

A normal C-clamp has a single structure to form the 'C' part of the clamp. This invention uses a double structure which gives several advantages. The double 'C' plates 3 allow easy insertion of an easily controllable pressure plate 1 to provide separating force of the two flanges, 14 and 15. Such easy control is desirable because boat repairs can then be done with less skilled labor, with less auxiliary devices, with less time and in more field environments. The double 'C' plates 3 provide thrust that is more precisely transverse to the toe rail extrusion profile and gave surprisingly precise local straightening action on bent toe rails 14. The double 'C' plates 3 also surprisingly reduced the tendency of the clamp to rotate with the turning of the thrust bolt 5, as is common with normal C-clamps.

A set of dimensions was tried for a device to pry flanges, 14 and 15, apart and discovered to work well on multiple boats at multiple locations on the boats and with various degrees of initial damage.

Design geometry and dimensions swirled around discoveries and developments to produce a device for prying apart the flanges of extrusion profiles, a device that:

- fits around the flanges, 14 and 15, to be pried apart,
- uses a screw action 5 to pry flanges, 14 and 15, apart,
- uses a pressure plate 1 to pry the flanges, 14 and 15, apart and to avoid undesired flange warping,
- uses 'C' plate extensions 4 to be the fixed opposition to the prying action,
- is strong enough to pry apart the flanges, 14 and 15,
- allows the device to get tightly into the intersection of the flanges, 14 and 15,
- allows use of an easily attached versatile hooking 9 action (and spacers 10 as needed) to fine tune the fit around different flange designs (as well as to accommodate changes in the fit as the flanges are pried apart),
- allows elimination of rotation of the device when the thrust bolt 5 is turned,
- is small, light enough to be practical for on-board repair use and
- for flange intersections below 90 degrees, that are to be pried apart, provide for the thrust bolt 5 thrust direction against the pressure plate 1 to automatically intersect inside the lip of the flange 14.

Figure 2:
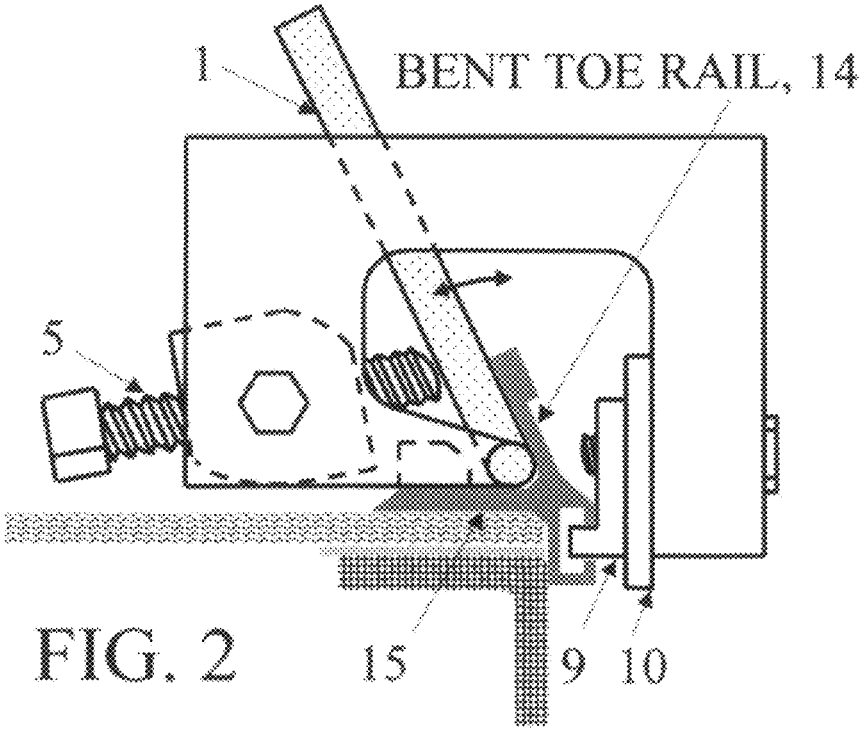
FIG. 2 shows a side view of the invention attached to a boat toe rail profile's crushed in vertical flange 14.

The principles discovered and developed for repairing damaged boats' damaged aluminum extrusion toe rail profiles FIG. 2 should also be applicable to other extrusion profiles extrusions. Other profiles would include other materials, wider flanges and/or thicker flanges. Engineering principles can be used to modify the specific dimensions of the device to fit the extrusion profile in question. The invention provides the basic geometry concepts. One can use the successful geometry and dimensions of this invention, as described in Table I, as successful starting point dimensions to modify the device design as needed. E.g, one can use a modulus comparison with the aluminum profiles in examples 1 and 2 versus the material of the extrusion profile in question. e.g one can use a cubic relationship of thrust versus flange thickness and the 3/16 inch thick flange profile in example 2's boat toe rail.

Steel is the preferred basic material for fabrication of the components of the device in this invention. A hook plate 9 and possibly an attendant spacer plate(s) 10 are possible exceptions, as is discussed later. The higher strength of steel, versus aluminum, helps compensate for the additional prying resistance of the flange that extends beyond the side edges of the pressure plate.

The 'C' plates 3 of the device reach over the top of the flange 14 to be pried apart as would be expected of a C-clamp device. The backside of the 'C' plates grip the backside of the profile as would be expected. One of the novel differences with this invention is that the thrust bolt sides of the 'C' plates have extensions 4 under the thrust bolt 5, extensions 4 that reach into the intersection of the flanges, 14 and 15, be pried apart, a pressure plate 1 pivot point.

The novel extensions 4 contact and position the base of the pressure plate 1. The thrust bolt 5 contacts the pressure plate 1 that provides the actual contact with one of the surfaces 14 to be moved apart, such as the vertical surface of a boat's toe rail 14. The extensions 4 of the 'C' plates 3 are the contact with the other surface 15 to be moved apart, such as the horizontal hull-deck connector plate portion 15 of a boat's toe rail profile. Rotation of the thrust bolt 5 then uniquely pushes the surfaces 14 and 15 apart, such as moving a boat's bent toe rail back to its original right angle position.

The pivoting pressure plate 1 positioning came from development of a 'C' plate 3 design that has a novel extension 4 under the thrust bolt 5. The extension 4 extends into the intersection of the flanges to be pried apart, 14 and 15, and provides an opposing surface for the pressure plate 1 to push against. The intersection of the flanges becomes the pivot point of the pressure plate 1 as it intersects with the end of the extension 4.

A surprising discovery was made of the pivot point design. It was found that the 'C' plate extension 4 slot shown in FIG. 3, versus a captured rotating post FIG. 6, gave a device with reduced sensitivity to a perfect fit of the device to the toe rail to be straightened.

The term aluminum includes any alloy, whose main component is aluminum. The term steel includes any iron containing alloy, whose main component is iron.

The following portion of the detailed invention description describes individual components of the device. The detailed description is primarily based on the use of the preferred dual 'C' plates but also describes how the invention can be used for single 'C' plates. The detailed description is also primarily based on use of the invention to repair boats' damaged aluminum extrusion toe rail profiles. But the invention also applies to different extrusion profile flange widths and heights as well as to different materials.

Pressure Plate 1:

The pressure plate 1 has advantages versus simply directing the thrust bolt 5 against the surface 14 to be pushed away (e.g. straightened). The pressure plate 1 allows the flange, such as a boat's bent toe rail 14, to straighten uniformly versus potentially warping from a thrust bolt's single contact point and producing an undesirable 'S' or '(' shaped flange or toe rail.

The pressure plate 1 allows the thrust bolt 5 to be more horizontal and have less interference with a parallel horizontal surface, such as a boat deck 16 beneath the horizontal flange 15 of a toe rail. The pressure plate 1 distributes the thrust more uniformly and with more consistent control than thrust from only the end of a thrust bolt 5. The plate 1 described in this invention is also narrow enough to permit controlled straightening of either narrow damaged segments or controlled sequential straightening of longer segments of damaged toe rails.

The design width of the pressure plate, 1 ½ inch, was based on the width of the thrust bolt housing 6. That 1 ½ inch wide pressure plate 1 turned out to be a surprisingly workable width for repairing boats' toe rails as one worked down the length of a bent toe rail. It was narrow enough that the thrust bolt size and other dimensions selected were strong enough. It was narrow enough to accommodate precision damage repair. It was wide enough to prevent laborious repetition during repair.

The pressure plate 1 width needs to have sufficient clearance to move between the two 'C' plates 3.

The pressure plate 1 is extended in length to provide a handle, if needed, to reduce or eliminate 'C' plate 3 rotating tendency of the device as the thrust bolt 5 is turned. The rotating tendency of the whole device is especially sensitive to single 'C' plate options with the device. If forces rotating the device are nominal, an operator can use the handle to stop such rotation manually. If the forces are greater, the handle can be used to brace the device against rotation. The dual 'C' plate 3 design surprisingly eliminated the rotation problem for the boat toe rail application. However, the long pressure plate 1 handle still proved to be useful during assembly of the device around damaged toe rails and over water. The preferred pressure plate 1 pivots in slots, FIG. 3, versus holes in the extension ends, FIG. 6. This means the pressure plate 1 is a separate piece and the handle facilitated assembly. The preferred pressure plate 1 length extends 3-5 inches above the top of the 'C' plates 3 to be both effective and practical for field use.

The pressure plate 1 has a hemispherical shape at its bottom that allows it to rotate in the corner of the intersection of the two flanges being pried apart, FIG. 3. The normal fillet radius of an aluminum toe rail extrusion, approximately 3/16 inch, means a tight fit into the flanges' corner requires a hemisphere ⅜ inch wide. The resultant ⅜ thick pressure plate 1 is only 50 percent thicker than the ¼ inch root of some toe rail flanges 14. The problem is that the lips of the toe rail flanges 14, that extend beyond the width of the pressure plate 1 edges, sometimes exceed ½ inch thicknesses, which puts significant extra resistance to prying the flanges, 14 and 15, apart and into a 90 degree position. Even with the strength boost from steel device construction, it was surprising that a ⅜ inch thick pressure plate 1 and ⅜ inch diameter pressure plate wings 2 were strong enough to straighten boat toe rail flanges 14 successfully in Examples 1 and 2.

The results, described above, cause the preferred thickness of the pressure plate 1 to be 5/32 to 7/32 inch for repairing boat toe rails 14.

However, if the profile flanges' fillet radius becomes less than ½ the thickness of the flange section to be bent, then the pressure plate thickness 1 will have to be at least 1.1 times the thickness of the flange 14, preferably 1 ½ times the thickness. This will potentially undesirably position the base of the pressure plate 1 out and away from the flanges' intersection. Such a move will potentially result in warping the flange 14 into an undesired 'S' or '(' shape, or some combination thereof, depend on the flange-pressure plate contact points. Shims can potentially resolve the issue and are a complication that may or may not be necessary, depending on the warping tendency of the particular toe rail 14.

Warpage tendency is partially alleviated at low strain levels by the need to exceed the elastic limit before warping can occur. The variation in toe rail 14 geometry and in toe rail damage make such alleviation unpredictable. It was a surprise that the device avoided flange 14 warpage when the toe rail 14, FIG. 8, in Example 2 was straightened. Example 2's toe rail 14, FIG. 8, has the normal strengthening/thickening of the lip of the toe rail. But in the case of Example 2's toe rail, the thickness extends out over the inside of the flange's lip. This prohibited the pressure plate from perfectly matching the face of the flange being straightened. However, the device was still found to be surprisingly effective in that it straightened the flange without warpage effects from the small offset. This means the device is relatively universal in its ability to repair the variety of toe rails geometries found on boats.

The bottom of the pressure plate 1 has cylindrical wings 2 that are transverse to the plane of the thrust bolt 5 and are aligned with the hemispheric bottom of the pressure plate 1 such that only one rounded surface fits into the intersection of the flanges, 14 and 15, to be pried apart.

Method 1, the preferred method, is to have these wings 2 fit into hemispherical grooves at the end of the 'C' plate extensions 4 on the thrust bolt side of the 'C' plates, FIG. 3. This allows the wings 2 to be larger, stronger versus method 2, below, and still fit as well into the profile extrusion flanges' intersection. The preferred thickness, above, of the pressure plate 1 extends to the preferred thickness of the wings 2 in method 1 being the same as the pressure plate 1 thickness.

Method 2 is to have the above pressure plate cylindrical wings 2 fit into holes in the ends of the 'C' plates' extensions, FIG. 6. In this configuration the ends of the 'C' plates' extensions 4, above, need to have the same radius as the hemispherical pressure plate 1 bottom. In this configuration the alignment of holes and wings 2 needs to be such that the surface of the end of the pressure plate 1 is in alignment with the rounded ends of the 'C' plate extensions 4 such that a continuous rounded surface fits into the flanges' intersection, above, no matter what position the pressure plate 1 is moved to by the thrust bolt 5. The preferred thickness of the wings 2 in this method, method 2, is ¼ inch for repairing boat toe rails.

A surprising result of method 1, above, was that in combination with the thrust bolt housing 6 location, described later, the pressure plate 1 base automatically positioned itself tightly into the flange intersection when thrust bolt 5 force was applied. The advantages are described later.

Rectangular bar stock or channel iron could be used for the base construction of the pressure plate 1. Bar stock is preferred as it simplifies geometry, strength and device fabrication considerations.

If 'U' shaped channel is used for the pressure plate 1, versus a solid profile, a thicker pressure plate may be needed to provide adequate strength. A thicker pressure plate 1 will more quickly run into the problem of exceeding the profile fillet geometry limits on pressure plate 1 thickness. Too much excess pressure plate thickness beyond double the fillet radius and the pressure plate may no longer force the flange 14 into position without warping the flange 14. One approach is to taper the stationary flange 15 side of the pressure plate 1 as it nears the flanges', 14 and 15, intersection. This will solve the problem of warpage potential, but will leave a potential pressure plate 1 weakness at the bottom of the pressure plate. However such a non preferred design will still work for some applications.

However if other flange geometry and/or materials require more force per linear inch of flange than the example used, the pressure plate 1 width can be reduced as needed to help with a stronger design. It is preferred to maintain the wider width at the pressure plate base to retain the geometry of the thrust bolt housing, etc. Enough pressure plate 1 width above the wings 2 should be retained to keep the wings in position at the ends of the 'C' clamp extensions 4. A backing shim may be needed between the base of the pressure plate 1 and the connector piece 7 if the forces are too great for the new length of the pressure plate wings 2.

'C' Plates 3, General:

The preferred 'C' plate 3 arrangement is with double, versus single, 'C' plates for reasons described earlier.

The following detailed invention description is for the preferred dual 'C' plate 3 method.

The 'C' plate thickness that was discovered to work for boat aluminum toe rails, ½ inch, is the same as the thrust bolt diameter, that was also discovered to work well.

'C' plate 3 portions at the top of the plates and at the hooking end of the 'C' plates worked well when their widths were twice their thicknesses. In the case of a boat toe rail repair device, the preferred widths would be approximately one inch.

'C' plate 3 portions at the thrust bolt 5 end of the 'C' plates should also work well with widths double their thickness. However it is preferred to have their thickness the same at the cube dimensions of the preferred pivoting thrust bolt housing 6. This would make the preferred width triple the thickness of the 'C' plates 3, or approximately 1 ½ inches in the case of a toe rail repair device.

Internal fillets of ⅜ inch radii for the 'C' plates 3 worked well to eliminate undesirable weakness from stress concentrators.

There should be a gap between the end of the 'C' plate extensions 4 and the inside surface of the hooking action side of the 'C' plates. This is to provide room to grip the back of the profile that is to have a flange 14 straightened. It is useful to be spacious enough for various hook 9/spacer plate 10 configurations for various profile shapes. A gap of approximately 1 to 1 ½ inches for boat aluminum toe rail extrusion repairs is preferred.

The hooking side of the 'C' plate 3 should extend below the plane of the bottom of the extensions 4 so the hook action can better act as a hook and/or can better support hook plates 9. Extending approximately ½ to 1 inch is preferred for boat toe rail aluminum extrusion repairs.

Although preferred, a pressure plate system does not have to have dual 'C' plates 3 to work. A single 'C' plate 3 will work with a straddling pressure plate, FIGS. 9, 10 and 11. The straddling pressure plate, FIG. 10, would also benefit from a hemispherical bottom to ride in the intersection of the flanges, 14 and 15, to be separated. The straddling pressure plate 1 in FIGS. 9, 10 and 11 would need a slot at its bottom to insert a rod 2 (FIGS. 9, 10 and 11) for contact against, or attachment to, the 'C' plate extension 4 (FIGS. 9 and 11) to provide a rotating pivot point. The straddling 'C' plate option would require a thick section in the 'C' plate 3 (FIGS. 9 and 11) to allow a threaded hole for the thrust bolt. It would be awkward, but one could make such a 'C' plate section thick enough to mount a pivoting piece for a threaded hole for the thrust bolt 5.

The pressure plate 1 (FIGS. 9, 10 and 11) could be short enough to fit under the 'C' plate 3 (as shown in FIGS. 9 and 11) or pressure plate extension(s) could be abbreviated in width or notched to run alongside the 'C' plate, versus between two 'C' plate.

The straddling concept is not preferred because of the increased rotational potential of the 'C' plate as the thrust bolt 5 is turned against serious resistance. Another disadvantage is that it would be more difficult to provide the precise perpendicular thrust against a damaged toe rail 14 that gives precise repair control. The single 'C' plate would have less applications or have to be thicker to compensate for the strength and stiffness loss of a single 'C' plate versus two 'C' plates.

Another, also less preferred, option would be to mount the thrust bolt housing and the pressure plate alongside a single 'C' plate as shown in FIGS. 12 and 13. The thrust bolt housing could be fixed or pivotable 6. A side mounted system would require extra mounting strength as tensile and compressive stresses would be added to the shear stresses on the mountings when the device is used.

A single 'C' plate 3 would also require a connection mechanism 8 for the appropriate hook 9 and spacer 10 plates, discussed later. This could be done with another thick 'C' plate section 8 as shown in FIGS. 12 and 13. This could also be done by mounting the hook and spacer plates to the single 'C' plate with a backing plate that uses two or more bolts to clamp the hook and spacer plates to the 'C' plate. Again, the desired precise perpendicular alignment against the profile extrusion would be more difficult to control versus dual 'C' plates. Specifically, the backing action of the 'C' plate extension 4 is offset as shown in FIG. 13.

'C' Plate Extensions 4:

The novel extensions 4 are the bottom part of the thrust bolt 5 end of the 'C' plates 3 and project inward. The extensions' 4 bottoms are preferred to extend at a right angle to the end of the 'C' plates 3.

These extensions 4 press against one of the flanges being pried apart and in the case of boat toe rails, press against the top of the deck plate 15. The extensions 4 operate in opposition to the pressure plate 1 and are the fixed component of the prying action to move the extrusion flanges, 14 and 15, apart. The ends of the extensions 4 fit into the extrusion flanges', 14 and 15, intersection and help position the base of the pivoting pressure plate 1 there.

To fit around the flanges, 14 and 15, to be pried apart, the bottom of the extensions 4 should be as far from the underside of the top of the 'C' plate 3 as is the length of the longest flange 14 to be straightened. This is best at approximately 2 to 2 ½ inches for boat aluminum toe rail extrusion repairs.

To fit around the flanges to be pried apart, 14 and 15, the 'C' plate extensions 4 should extend out from the inside surface of the thrust bolt side of the 'C' plate 3 by at least the distance that the flange 14 to be straightened is bent back. The preferred extension 4 length is approximately 1 ¼ to 1 ¾ inches, along the top of the extensions 4, for boats' aluminum toe rail extrusion repairs.

For strength the 'C' plate extensions 4 should increase in height as they extend back toward the end of the 'C' plates 3.

The top edge of the extensions 4 should angle back at 3 to 30 degrees above a line parallel to the extensions' outside edge. Different angles will work. More is stronger, but weighs more. Less is lighter but weaker. The preferred angle is 12-18 degrees.

The outer end of the extension 4 should be strong enough to support the prying stresses at the flanges' intersection, small enough to get into that intersection, with geometry to get into that intersection and with geometry to fit the base of the pressure plate 1.

The location/size of the thrust bolt housing 6, described later, influences the minimum angle that extensions 4 and pressure plates 1 can have and still reach the intersection of the flanges, 14 and 15. The device used in Examples 1 and 2 have a minimum flange angle that can be pried apart of about 40 degrees. That is appropriate for boats' damaged toe rail 14 repair. If smaller flange angles are to be addressed, the device can be lengthened and the extensions 4 correspondingly lengthened. This will move the thrust bolt housing 6 back and will permit the pressure plate 1 to lay back more. Enough adjustment should permit the device to go as low as 20 degrees of flanges' separation that can be straightened back.

Method 1, in the pressure plate 1 description above, requires the end of the extensions 4 be horizontal hemispherical slots, FIG. 3. As such, the height of the end of the extensions 4 will be the same as the diameter of the wings 2 in method 1, 5/32 to 7/32 inch being the preferred height.

Method 2, in the pressure plate 1 description above, is to have the above cylindrical wings 2 fit into holes in the ends of the 'C' plates' extensions 4, FIG. 6. In this configuration the ends of the 'C' plates' extensions 4 need to be horizontal hemispheres with the same radius as the hemispherical pressure plate 1 bottom, 5/32 to 7/32 inch preferred. In this configuration the alignment of holes and wings 2 is such that the surface of the end of the pressure plate 1 is in alignment with the rounded ends of the 'C' plates' extensions 4 such that a continuous rounded surface fits into the flanges', 14 and 15, intersection, above, no matter what position the pressure plate 1 is moved to by the thrust bolt 5. If method 2 is used, horizontal holes need to be in the ends of the extensions 4, FIG. 6. The holes need to have the same centers as the hemispherical radii of the extension 4 ends and have hole diameters just large enough that the pressure plate 1 wings 2 can rotate. The holes in the extensions 4 need to be slightly larger than the preferred ¼ inch diameter wings for Method 2.

The method 1 system is preferred as it will be stronger and has the potential for better pressure plate 1 positioning in the intersection of the flanges, 14 and 15.

Thrust Bolt 5:

The selection of the size of the thrust bolt 5 is critical for several reasons. Too small and it will buckle when the device is used for some applications. Too large and the cascading effect on sizing other device components can cause non optimum operation. For example if the necessary thrust bolt housing 6 becomes too large then the optimum thrust angles may not be achieved or the pressure plate 1 may become too wide. One of the design surprises was that experimental results in Examples 1 and 2 showed a ½ inch diameter thrust bolt 5 produced a device that was successful in all respects.

The preferred thrust bolt 5 has a small square head. This gave several surprising benefits. One discovery was that, a small thrust bolt 5 head causes less interference with a horizontal surface under the horizontal flange, such as a boat deck 16, and improves the bolt's thrust alignment options. Specifically, the thrust direction can be less of an offset from a strong 90 degree intersection with the pressure plate 1. A further value of this type bolt is that they are threaded right up to the head. This permitted the use of shorter thrust bolts 5 and the resultant further ability to have more optimally upwardly directed thrust.

It is also noteworthy that the square headed bolts are the harder, stronger steel that is more useful for the thrust bolt 5. It is useful to round the end of the thrust bolt 5 to avoid thread contact with the pressure plate 1. This avoids damage to the thrust bolt 5 threads or to the pressure plate 1.

A technique for boat toe rail 14 straightening is to start with a shorter thrust bolt 5 that will not interfere with the deck 16 while the bolt is tilted up to allow a more powerful angle against the pressure plate 1 that is tilted back because of the bent flange, FIG. 2. A longer thrust bolt 5 can be inserted as needed as the toe rail flange 14 straightens up, FIG. 3.

Figure 14:
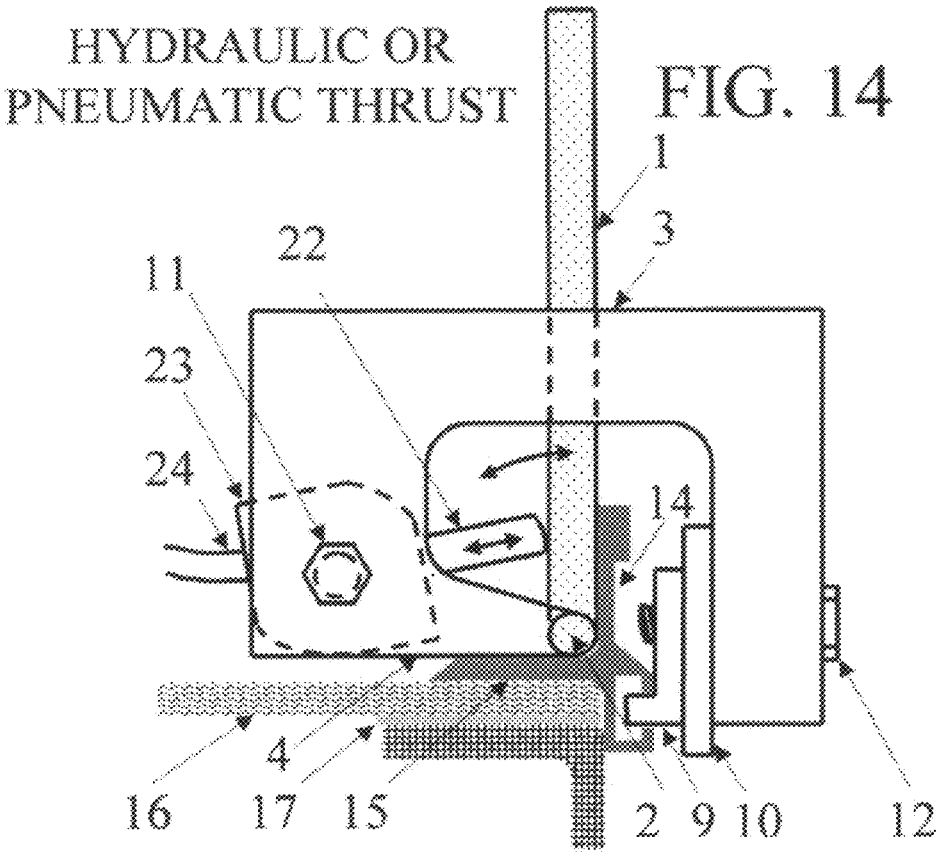
FIG. 14 shows how a hydraulically or pneumatically driven rod can substitute for the thrust bolt.

Thrust can be directed toward the pressure plate with other means than with rotating a threaded bolt 5. For example one could use a hydraulically driven rod 22 as shown in FIG. 14. The term thrust bolt, as used in this invention description, means any method, including rod like structures, to drive the pivoting pressure plate 1 towards an intersecting flange 14 to be bent. Any means that has geometry to use the extensions 4 as an opposing die.

Hydraulic action is not preferred for boat toe rail repair because it is unnecessarily cumbersome. But some flange designs, other than boat toe rails, may require more bending force than is reasonable with a manual action. FIG. 14 shows how a pressure cylinder 23 can be substituted for the thrust bolt housing. The hydraulic pressure can be supplied via a pressure hose 24, that can be fed by either a manual or powered hydraulic pump.

Another possible but also less preferred method is to substitute pneumatic action for the thrust rod 22. It would also be cumbersome for boat toe rail repair but could be done with the compressed air sources common to boat yards. The system would be similar to the hydraulic design described in FIG. 14, except the thrust housing 23 and the hose 24 would be pneumatic instead of hydraulic.

A third alternative to a threaded thrust bolt would be a mechanical camming action to drive a rod 22, that would move the pressure plate 1. Such a device might be potentially less cumbersome than hydraulic or pneumatic gear. If one used a long enough pressure plate 1, one could get enough leverage to straighten most boat toe rails. However, the collateral prying action on the deck-hull, 16 and 18, joint and seal 17 negates the protection to that joint that this invention was designed to provide.

Figure 15:
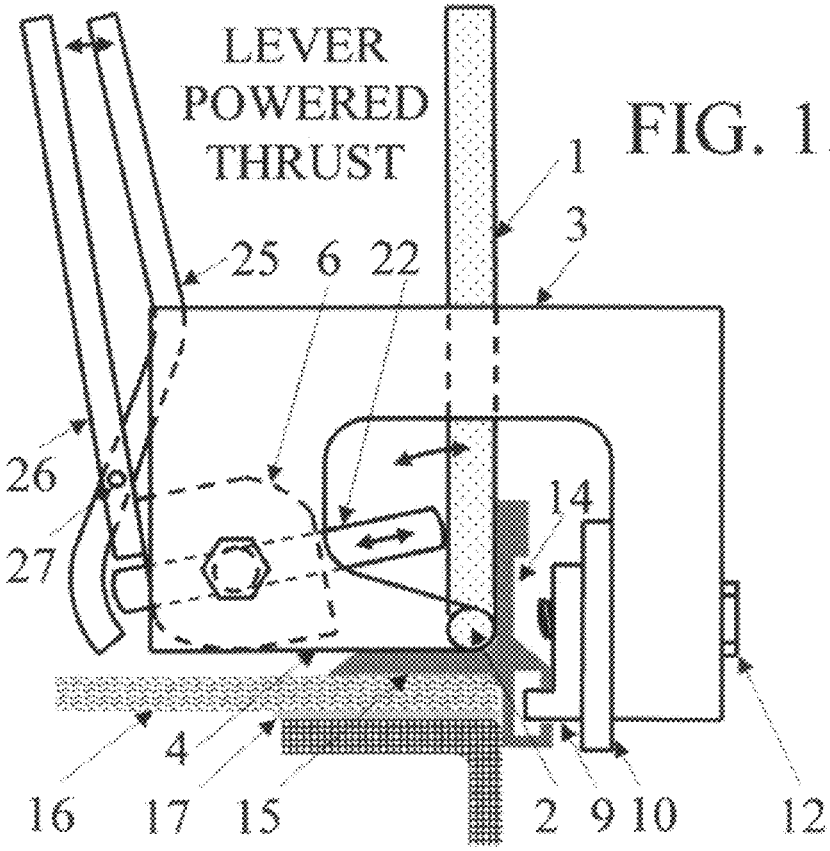
FIG. 15 shows how a lever driven rod can substitute for the thrust bolt.
Figure 16:
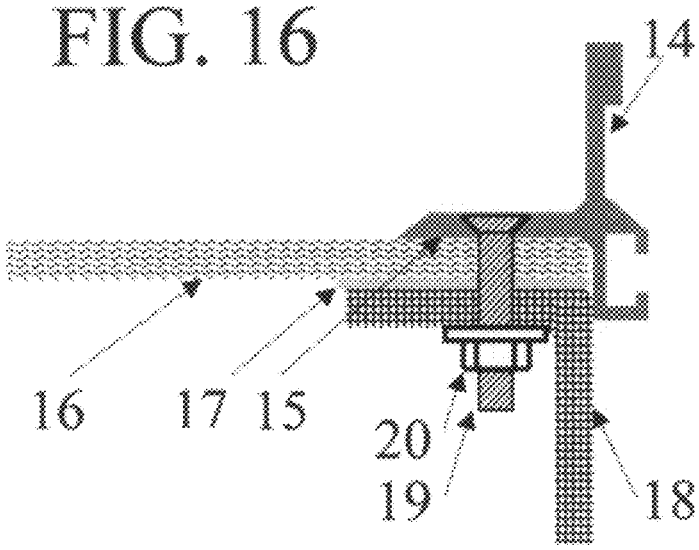
FIG. 16 shows a typical toe rail profile used as a hull-deck connection on a fiberglass boat.
Figure 17:
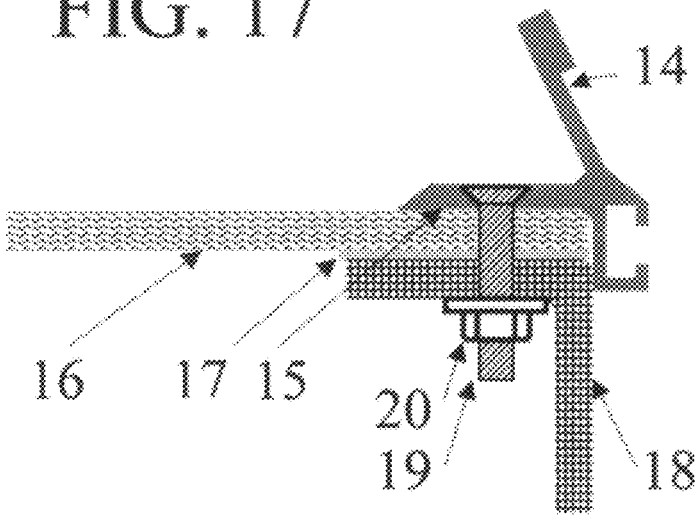
FIG. 17 shows a boat's vertical toe rail profile flange that has been damaged, crushed inward.

A better way to use lever power is to use the thrust rod 22 design in this invention and apply the prying force as described in FIG. 15. An extension 26 can be attached to the thrust rod housing 6. A prying lever 25 can be pinned 27 to the housing extension 26. The lever 27 and the housing extension 28 can be squeezed, as with channel lock pliers, and provide the force to the pressure plate 1 to straighten a bent toe rail 14. Such a device would incorporate the design advantages of this invention in that the flange prying forces would be divorced from the prying action against the deck-hull, 16 and 18, connection. However the simplicity of using a threaded bolt is preferred.

Another reason the threaded bolt is preferred to the hydraulic, pneumatic and lever methods, described above, is the better control and precision available to a lesser skilled operator with simple bolt turning. Each repair job will be different, even on the same boat and such control reduces the risk of over bending with the resultant extra labor and the profile weakening of having to bend the toe rails back inward again.

Thrust Bolt Housing 6:

The width of the housing's metal, surrounding the thrust bolt 5, is preferred to be the same as the thrust bolt 5 diameter to provide adequate strength. The thrust bolt housing 6 also acts as a connector between the two 'C' plates 3. The selection of the thrust bolt 5 diameter thereby cascades into controlling the preferred gap between dual 'C' plates 3 and its attendant limitation on the maximum width of the pressure plate 1, both being approximately 1 ½ inches for a preferred boat toe rail repair device.

Analysis of the experimental results in Example 1 indicates a desire to have the thrust bolt 1 thrust be aligned inside (below) the lip of the flange 14 to be bent. The automatic positioning of the pressure plate 1 base is the cause of the desire. It was surprisingly discovered with the above thrust bolt 5 geometry arrangement that when turning the thrust bolt 5, it first pushes the bottom of the pressure plate 1 against the intersection of the flanges, 14 and 15, being pried apart. Further turning of the thrust bolt 5 against the pressure plate 1 then forces the flanges, 14 and 15, apart evenly, such as straightening a toe rail 14, without warping the flanges 14 into undesired 'S' or '(' shapes. It was discovered that the automatic movement of the pressure plate 1 base into the flanges', 14 and 15, intersection was a serious time saver. A bent flange 14 requires several spacer plate 10 changes as it is pried apart, such as into a straightened boat toe rail. The thrust arrangement, described here tolerates less hooking action precision and less laborious readjustment of the hooking action.

A preferred location of the thrust bolt housing 6 is such that it is flush or just above the bottom plane of the 'C' plates 3 at that end. Such a preference applies to extrusion profile flange angle expansions where the final angle is to be approximately 90 degrees or less. Insufficient thrust bolt 5 strength may require raising the thrust bolt housing 6 to reposition the thrust bolt 5 for more leverage for some applications other than boat toe rail repair.

If the original or final extrusion profile angle between the flanges to be spread apart is greater than 90 degrees the situation may cascade into a device design adjustment to move the thrust bolt housing 6 to a position near the top of the end of the 'C' plates 3 for more leverage against the flange to be moved. Spare holes in the 'C' plates 3 may be useful if such situations are likely.

It is preferred to have this 'C' plates' connector, the thrust bolt housing 6, be able to pivot. It was discovered that a pivotable thrust bolt housing 6 gave surprisingly broad and easily implemented options to avoid interference of the thrust bolt head rotation with other structures, like a boat deck 16. A combination of different thrust bolt 5 lengths and the pivoting feature of the thrust bolt housing 6 gave great flexibility in applying the necessary thrust and thrust angles to bend/pry apart profile flanges, 14 and 15, without interference problems with surfaces, like boat decks 16. It permitted the easy adjustment of thrust angle as the extrusion profile flanges', 14 and 15, angle opened up.

The preferred method of permitting and controlling the pivoting of the thrust bolt housing 6 is to mount the housing 6 to the 'C' plates 3 with adjustable bolts 11.

Aligning the mounting bolts 11 perpendicular to the thrust bolt 5 and thru the center of the thrust bolt housing 6 gives the simplest and most symmetrical situation for controlling the thrust bolt 5 thrust direction.

Using the same diameters for the mounting bolts 11 as for the preferred pressure 1 plate wings gives the same shear stress on the mounting bolts 11 as on the pressure plate 1 wings. The makes ⅜ inch the preferred mounting bolt 11 diameters for a boat toe rail repair device. The desire for strength was pursued by having as much metal around the mounting bolts 11 as the bolts are wide That makes the thrust bolt housing 6 a 1 ⅛ by 1 ⅛ inch width at that point. However one of the thrust bolt housing 6 dimensions is controlled by the 1 ½ by 1 ½ inches width around the ½ inch thrust bolt 5. A preferred simplifying solution is to make the thrust bolt housing 6 a 1 ½ inch cube.

The two intersecting holes thru the thrust bolt housing 6 are both threaded. The non threaded holes in the 'C' plates 3 to hold the thrust bolt housing unit are located to hold the bottom of the housing unit 6 flush with the bottom and the end of the 'C' plates 3. The outside, bottom corner of the housing unit 6 needs to be rounded or chamfered to avoid interference below the 'C' plates 3 when the housing unit is pivoted. The inside, top corner of the housing 6 needs to be rounded or chamfered, as needed, to permit maximum movement of the pressure plate 1 into extrusion profile flanges, 14 and 15, intersections as small as 40 degrees.

Using only the two other 'C' plates' connections 7 and 8, as located and described below, permits the 'C' plates 3 to flex enough to give a tight fit for the pivoting connector 6. Lock washers are also helpful in maintaining a tight grip on the pivoting connector 6, such that the thrust bolt 5 does not move except out through the threads in the pivoting connector 6.

In spite of significant stresses, the system above gave surprisingly successful results in Examples 1 and 2. The system has: sufficient strength to straighten boat toe rails, easy adjustments to avoid deck damage, easy adjustments for needed thrust angles and no unwanted pivoting out of the thrust bolt housing's locked positions.

Another, but less preferred, position for the thrust bolt housing 6 would be to locate it on/in the pressure plate 1. The thrust would than be back toward the back of the 'C' plates 3, somewhat like the thrust direction in Smith's U.S. Pat. No. 2,687,162. Unlike Smith's invention, this invention comprises both the novel 'C' plate extensions 4 to reach into the flange intersection and provide backing support at the right place and in the right direction to pry apart the flanges, 14 and 15, as well as comprises a pressure plate 1 that can reach into the same intersection.

The pressure plate housing of the thrust bolt, described immediately above, would require addition of a backing plate connector across the back of the 'C' plates 3 to capture the thrust from the thrust bolt and transfer the stress to the bottom of the extensions 4. Although this would work for some applications, this is not the preferred method. This thrust geometry of this method, unlike the preferred method, would first push the pressure plate 1 'away' from the flange intersection before being captured by the ends of the 'C' plate extensions 4 and proceeding to straighten the flange 14. Although this method will work, it requires extra diligence and adjustments in the hooking assembly 9 and 10.

'C' Plate Fixed Connectors 7 and 8:

The 'C' plates 3 are connected at the end of the 'C' plate extensions 4 by a connector piece 7 that does not interfere with either the action of the pressure plate 1 nor interfere with the pivotable housing 6 that holds the thrust bolt 5. Within these limits the connector 7 should be located near the end of the extensions 4 and be about the same height as the ends of the extensions 4, 5/32 to 7/32 inch for the preferred boat toe rail repair device. The preferred length alongside the extensions 4 for a device to repair boat aluminum toe rail extrusion profiles is approximately ⅞ to ¾ inch long, with the top corners beveled. The width of the connector 7 across the 'C' plates' 3 gap should be the same as the thrust bolt housing 6, 1 ½ inches for the preferred boat toe rail repair device.

It is preferred that the bottom of this connector 7 should be flush with the bottom of the 'C' plates' extensions 4.

Note: The thrust bolt housing 6 also acts as a 'C' plates' 3 connector. The proximity of this connector 7 to the thrust bolt housing 6 and the desire to firmly clamp the thrust bolt housing 6 into position make it important that the connector 7 not be wider than the thrust bolt housing 6. Connector 7 was used in Examples 1 and 2, but its proximity to the trust bolt housing likely make it redundant.

The other fixed connector 8 is positioned on the hooking side of the 'C' plates 3 and like the other connector 7 fills the same gap width as the thrust bolt housing 6, 1 ½ inch for the preferred boat toe rail repair device.

If auxiliary hooking 9, and possibly spacer, plates 10 are used, the connector 8 between the hooking ends of the 'C' plates 3 will also serve as the mounting position of those auxiliary plates.

The connector 8 on this side should be flush with the inside surfaces of the 'C' plates 3 such that a hooking plate 9 and/or hooking plate spacer(s) 10 will contact a reasonably uniform flat surface.

The 'C' plate 3 thickness is an adequate thickness for the connectors 7 and 8. That would be ½ inch for the preferred boat toe rail repair device.

If the extrusion flanges are to be pried apart to no more than 100 degrees, the length of this connector 8 on the hooking end is preferred to be the same as the height of this end of the 'C' plates 3. If the angle is to be 100 to 160 degrees, this connector 8 length can be shortened from the top as necessary to accommodate the pressure plate 1 movement above this connector 8.

The connector pieces 7 and 8 can be either bolted or welded in place. The connector pieces 7 and 8 can be made from either solid bar stock or channel stock. Welded bar stock is preferred for ease of manufacture and better long term rigidity.

The connector piece 8, that holds the hooking plate 9, has two mounting holes as shown in FIG. 4. This is in case the user wishes to use either of the two hooking assemblies described below. Both holes should be centered between the 'C' plates 3. For a toerail straightening device the bottom hole should also be centered 3/16 inch below the bottom plane of the 'C' plate extensions 4 and should be a threaded hole for a ⅜ inch diameter bolt. For a toerail straightening device the top hole should also be centered ⅜ inch above the bottom plane of the 'C' plate extensions 4 and should be a threaded hole for a ½ inch diameter bolt.

Hooking Assembly 9 and 10:

A hooking action is needed on the end of the 'C' plates 3, away from the thrust bolt 5, to prevent the thrust bolt 5 action from camming the pressure plate 1 and/or 'C' plate extensions 4 out of position. The 'C' clamps 3 themselves can provide this hooking action. However, because of the variety of profiles that can benefit from the device, a variety of hook sizes, spacing and geometries are needed. A permanent fixed hook design would have limited utility. Even for just boat toe rail repair there are so many profile designs that a fixed hook design would be often awkward and/or would require frequent major modification.

A fixed hook design will work but the hooking assembly methods/device features described in this invention comprises more preferred approaches.

A preferred hooking method is to have a set of spacers 10 and/or hook plates 9 held together with nuts and bolts. While better than the permanent hook action, described above, the complication of handling plates, bolts and nuts over the water while repairing toe rails increases the hazard of having to replace device parts that end up somewhere in the water below the boat.

A more preferred hooking assembly method is to use a combination of tapped and untapped holes in the various components, with the most preferred designs described below as Hooking Assembly Method 1 and Hooking Assembly Method 2.

Hooking Assembly Method 1 is shown in FIGS. 1, 3, and 5, is described as follows and will only use the top hole, FIG. 4, described above in the description of the 'C' plate connector 8.

The hooking end of the 'C' plates 3 can be fitted with an easily attached hook plate 9 and spacer 10 plate(s) option to keep the device in position. These hook 9 and spacer 10 plates can be quickly fabricated from easily obtained standard stock, such as aluminum channel and plate stock, to make the device applicable to a wide range of needs such as various toe rail extrusion profile shapes.

Some profiles, such as some toe rail profiles, have segments that are not particularly robust. If these segments are where one needs to hook a backing action against the straightening/prying device, care must be taken to avoid damage. The method discovered to work well was to have a hook plate 9 material, no harder than the toe rail material, and to have a wide hook plate 9 to spread out the load. For boat toe rail repair, the use of aluminum for hook 9 and spacer 10 plates produced a softer compression surface than steel.

For boat toe rail repair, the preferred width of the hooking plate 9 along the profile is triple to quadruple the width of the pressure plate 1 and the preferred spacer plate 10 widths are double to triple the width of the pressure plate 1.

The preferred thickness of the hook plate 9 for boat toe rail profile repair is ¼ inch with the hook being ¼ inch thick and extending ¼ inch out from the plane of the hook plate 9. There should be a series of threaded holes in the hook plate 9 to accommodate different hook locations for various toe rail extrusion profiles. The preferred thread diameter for a toe rail straightening device would be ⅜ inch.

This Hooking Assembly Method 1 uses the hooking plate smaller mounting bolt 12. For a toe rail straightening device the hooking plate smaller connecting bolt 12 in this method should be a ⅜ inch diameter bolt. The bolt 12 uses a washer 21 to avoid problems with being fed first thru the oversized top threaded hole in the 'C' plates' connector piece 8. If geometry requires a spacer, the bolt 12 then passes thru a spacer plate 10 with a hole just large enough to provide easy clearance. The bolt 12 then connects with a threaded hole in the hooking plate 9, that is located in the hooking plate 9 such that the hook is properly positioned to keep the device located where the pressure plate 1 can do the best job of straightening the flange 14.

The single bolt 12 connection between the hooking plate 9 and the 'C' plate connector 8, is preferred over multiple bolt connections because it allows more of a custom fit of the device to an extrusion profile. The preferred smaller hooking plate mounting bolt 12 bolt diameter for a toe rail straightening device is ⅜ inch.

If the original extrusion profile angle between the flanges to be spread apart is greater than 90 degrees, such angles may negate the movement of the base of the pressure plate 1 into the flanges' 14 and 15 intersection prior to exerting bending force on the flange 14. This situation magnifies the need for a precise fit of the pressure plate 1 into the flange intersection to avoid warping the flange 14 being bent. Such a need for a precise fit may cascade into multiple hooking location needs as spacing needs changes while the profiles are being pried apart. Another potential hooking action change is that when one goes through some flange angle changes the hooking need may change from holding the device down to holding the device up. Such situations further magnify the need for easy precise hooking location changes.

Example 2 surprisingly confirmed how a reasonably small collection of hook 9 and spacer 10 plates with a range of predrilled/pretapped locator holes in the hook plate 9 allowed one to easily adjust the unit to fit most boats in less than five minutes.

FIGS. 1, 3, and 5 show how to apply the hooking 9 and spacer 10 plates as a direct backing to the thrust bolt 5 action by being a hooking shim/contact between the toe rail extrusion profile and the 'C' plates 3.

Hooking Assembly Method 2 can be seen in FIG. 7, which shows another hooking plate 9 attachment method. Instead of a spacer plate 10, a second larger hooking plate mounting bolt 13 is used and the smaller hooking plate mounting bolt 12 is used differently.

The hooking plate 9 is positioned where it will hook behind the extrusion profile, that has the flange 14 that is to be straightened. The larger hooking plate mounting bolt 13 is threaded thru the top hole in the 'C' plate connector 8, threaded across the gap to the hooking plate 9 and into an appropriate threaded hole in a modified hooking plate 9. This positions the hooking plate 9. The hooking plate 9 modification is that the hooking plate in Hooking Assembly Method 2 requires a ½ inch threaded hole versus a ⅜ inch threaded hole.

FIG. 7 shows the smaller hooking plate mounting bolt 12 is threaded thru the bottom hole in the 'C' plate connector 7, threaded across the gap to the hooking plate 9 and to where the end of the smaller hooking plate mounting bolt 12 presses against the hooking plate 9, forcing the hooking plate 9 to behave as the backing for the pressure against the flange 14 being straightened.

The preferred material is steel for the hooking plate 9 for this Hooking Assembly Method 2.

The preferred hook plate 9 for boat toe rail profile repair is to still have the hook be ¼ inch thick and extending ¼ inch out from the plane of the hook plate 9. There should be a series of threaded holes in the hook plate 9 to accommodate different hook locations for various toe rail extrusion profiles. The preferred thread diameter in the hook plate 9 for Hooking Assembly Method 2 for a toe rail straightening device would be ½ inch and the hooking plate 9 should be at least as thick as the root of the flange 14 being straightened, preferably as thick as the pressure plate. The preferred thickness for the hooking plate 9 for a boat toe rail straightening device using Hooking Assembly Method 2 is ⅜ inch. The extra strength is to compensate for the lack of compression support from the 'C' plates 3 and the 'C' plate connector 8.

Note: the gap across between the end of the 'C' plate extension 4 and the inside end of the 'C' plate connector 8 should be enough to accommodate both the flange profile and the hooking plate 9 thickness.

The advantage of Hooking Assembly Method 2 over Hooking Assembly Method 1 is easier installation and adjustment as hooking plate spacers 10 do not have to be changed out. The disadvantages are potentially less strength and the hard steel contact against softer aluminum for boat toe rail repair.

Dimension Discussion:

A study of the various performance needs and how they affect the various device components' geometry and dimensions was described in the above teachings. This portion of the Detailed Description of the Invention summarizes the above component teachings and describes how they fit together for overall device design.

This dimensional discussion portion is primarily based on the use of the preferred dual 'C' plates 3, versus single 'C' plates. This portion is also primarily based on use of the invention to repair boats' damaged aluminum extrusion toe rail profiles. However, as described in the 'Summary of the Invention', engineering principals can be used to apply the invention to different extrusion profile flange widths and heights as well as to different materials.

It was discovered that the experimental results in Examples 1 and 2 can be applied to the dimensional criteria of the flanges to be pried apart to describe the design dimensions that resulted in a device that has the strength and geometry to successfully straighten bent aluminum toe rails on boat decks. One of the criteria is the fillet radius of the vertical 14 and horizontal 15 flanges of the toe rails. Another was the thickness of the vertical flange 14 where it was damaged/bent. The third was the height of the flange 14 to be pried away from the other flange 15.

The fillet radius is used to define the diameter of the pressure plate 1 bottom that rotated in the intersection of the vertical 14 and horizontal 15 toe rail plates. This diameter cascades into selection of the pressure plate 1 thickness and the dimensions at the end of the 'C' plates' extensions 4. The extension 4 end dimensions control one of the dimensions of the 'C' plate connector 7 at that location. The fillet radii further cascades thru the design criteria with pressure plate wing and thrust bolt housing mounting bolt 11 dimensions.

The thickness of the flange 14 to be pried apart is used to define the size of the thrust bolt 5 and the thickness of the 'C' plates 3. The trust bolt 5 dimension cascades into the design of the thrust bolt housing 6. Thrust bolt housing 6 dimensions and the 'C' plate thickness 3 cascade into the size of the gap and the connectors 7 and 8 between the 'C' plates 3, which also becomes the maximum pressure plate 1 width. The thickness of the 'C' plates 3 cascaded into more 'C' plate 3 dimensions, e.g. widths, to give reasonable stiffness ratios.

The extrusion flange 14 to pried apart has to be surrounded by the device for the device to function. The height of this flange obviously controls the overall height and width of the device as well as the length of the 'C' plate extensions 4.

The ratio approach was extended to design the invention's dimensions. It was unknown if the dimension ratios selected would produce a workable unit until the device was tried in Examples/experiments 1 and 2.

It was surprisingly discovered that the device would work successfully that was designed around the dimensional ratios selected. The contradictory design criteria of fitting into a tight extrusion intersection and the high, unknown exact strength needs made the original selection of key starting ratios an unknown until experimentation proved the numbers successful for repairing bent boat aluminum toe rails.

Table I summarizes the design ratios versus certain profile extrusions' key dimensions. The ratios in the table are the preferred ratios. Other values will work also as defined in the notes following the table.

TABLE I

| Optimum Straightening Device Dimensions for Boat Toe Rail Aluminum Extrusion Profiles | |
|---|---|
| Dimensions of flange 14 to be pried apart (numbers are in inches for typical boat toe rails): | |
| Height | H 2 |
| Root thickness | T ¼ (if thickness less than ¼", use the ¼" for the device design) |
| Fillet radius | R 3/16 |
| Dimensions of device: | |
| Pressure plate's 1 | |
| thickness | 2R (See exceptions in 'pressure plate' discussion) |
| width | 6T (See exceptions in 'pressure plate' discussion) |
| length | 4T + H + (3 to 5) |
| wings' 2 | |
| diameter | 2R (See exceptions in 'pressure plate' discussion) |
| length | 2T |
| 'C' plates' 3 | |
| Thickness | 2T |
| overall width | 10T + 1¼ H |
| overall height on thrust bolt side | 4T + H |
| overall height on hook side | 4T + 1¼ H |
| distance hooking end extends below extension | ¼ H |
| segment widths: | |
| at top | 4T |
| at hook end | 4T |
| at thrust bolt housing | 6T |
| Extensions' 4 | |
| length versus end of 'C' plate | 6T + ¾ H |
| angle of bottom versus back of 'C' plates | 90 degrees |
| angle of top, back from extension end | 15 degrees, up |
| ends' height | 2R |
| ends' horizontal slots' diameters | 2R |
| gap across from end of extension to the inside of the hooking side of 'C' plate | ½ H |
| fillet radii | 2R |
| Thrust bolt's 5 | |
| diameter | 2T |
| Pivoting thrust bolt housing's 6 | |
| cube: length, width, height | 6T |
| mounting bolts' diameter | 2R |
| Connector between 'C' plates, 7, at extensions | |
| width | 6T |
| thickness | 2R |
| length | 4R |
| Connector between 'C' plates, 8, at hook end | |
| width | 6T |
| thickness | 2T |
| height | 4T + 1¼ H (See exceptions in 'C' Plate Fixed Connectors, Two' discussion) |
| Hook plate 9 lengths along the profile | 20T |

TABLE I-continued

| Optimum Straightening Device Dimensions for Boat Toe Rail Aluminum Extrusion Profiles | |
|---|---|
| Spacer plate 10 lengths along the profile | 12-18T |

Table I Notes:

A. The dimensions in Table I work for most aluminum applications and are the preferred dimensions if the tolerances used are plus or minus five percent and if the construction is such that there are no interferences in fabrication or use.

B. If selected Table I dimensions, e.g. 'C' plate 3 thicknesses, are cut in half, and there are no interferences, the device will still work for many applications, but the strength loss will reduce the number of application.

C. If selected Table I dimensions are cut to one fourth, and there are no interferences, the weakened device will still work but for even less applications.

D. If selected table I dimensions are doubled, e.g. pressure plate 1 thicknesses, and there are no interferences, the device will still work, but thicker wings 2, extension 4 ends and/or pressure plates 1 at the flanges' junction will create the potential for warping the flange 14, being bent, into an 'S' or ')' shape. A wider pressure plate 1 (and the attendant wider connector pieces, 6, 7 and 8) will work for some applications, but more flange width to be bent will add more stress and will have less successful applications.

E. The warpage issue, in D above, is affected by the fact that the elastic yield limit will provide some limited tolerance to a mismatched pivot point—flange fillet. But once the yield limit is breached, the mismatch will cause the warping of the flange 14, described in D above.

F. If selected table I dimensions are quadrupled, and there are no interferences, the device will still work, but the warpage issues, described in note D, will be magnified.

G. Steel flanges 14 will have roughly double the bending resistance as aluminum ones with a similar thickness. One method to address the extra resistance is via doubling the force per linear inch by cutting the pressure plate 1 width in half Details of how are discussed in the pressure plate Detailed Description of the Invention section.

H. An increase in the flange 14 thickness can likewise be accommodated by this invention. The adjustments needed are similar to the design adjustments in note 6, except magnified. Instead of doubling the stress needs, the stress needs will have to be adjusted according to the cube of the increases in flange 14 thickness.

EXAMPLES 1 AND 2

Example 1

Test Device Options/Dimensions Used:

The device shown in FIGS. 1, 3, 4, and 5 was used for the test/demonstration device that was produced. A dual 'C' plate 3 design was used. A ½ inch thrust bolt 5 and ½ inch thick 'C' plates 3 were selected to test the design geometry and design dimension ratios. A 3/16 flange fillet radius and a two inch flange 14 height were used to test their interactive effects on the design geometry and design ratios. A boat's bent aluminum toe rail 14 in FIG. 2 was used. A pivoting thrust bolt housing 6 was used and was located at the base of that end of the 'C' plates 3. The 'C' plate extensions 4 used the hemispherical slot option. A hook plate assembly was used.

Steel was used for all straightening device construction in this example except for the spacer 10 and hook 9 plates, which were aluminum.

The 'C' plates 3 included extensions 4 that extended into the junction of the two boat toe rail flanges 14 and 15 to be pried apart. The extension 4 ends extended 1 5/16 inch beyond the inside of the end of the 'C' plates 3 to permit getting behind bent toe rails FIG. 2. The bottoms of the extensions 4 were at right angles to the end of the 'C' plates 3 and lay flat against the horizontal flanges 15 of the toe rails. This was demonstrated to be one of the surfaces prying the two toe rail flanges 14 and 15 apart. The tips of the extensions 4 had heights that were the thickness, 3/8 inch, of the hemispherical slots for the pressure plate 1 wings. The height of the extensions 4 increased at a 15 degree angle above the plane of the extension bases as the top of the extensions increased in height back towards the thrust end of the 'C' plates 3.

The width of the 'C' plates 3 at the thrust bolt 5 end was 1 1/2 inch. The width of the 'C' plates 3 at the top and hook ends were one inch. The spacing from the bottom of the extensions 4 to the inside surface of the top of the 'C' plates 3 was two inches. The hook plate sides of the 'C' plates 3 extended 1/2 inch below the plane of the bottom of the horizontal extensions 4 on the thrust bolt sides. The interior fillet radii of the 'C' plates 3 were 3/8 inch.

The gap between the end of the extensions 4 and the inside surface of the hook plate side of the 'C' plates 3 was 1 3/16 inch.

The 'C' plate portions, that are at right angles to the extensions, contained unthreaded holes to permit passage of the mounting/pivoting bolts 11 for the pivoting thrust bolt housing 6. The holes were centered in the width of the 'C' plates 3 and were positioned away from the extension 4 base a distance equal to half the thickness of the thrust bolt housing 6 cube, 3/4 inch.

The thrust bolt housing 6 location that was used required rounding the bottom outside corner of the thrust bolt housing 6 cube so it could pivot without interference.

The pressure plate 1 was mounted between the two 'C' plates 3 and was rectangular bar stock. Its base was hemispherical and had smooth pivoting rotation. Its width and thickness were 1 1/2 and 3/8 inches. Its seven inch length provided a handle grip to prevent rotation of the device when the thrust bolt 5 was rotated.

The base of the pressure plate 1 had two 1/2 inch long cylindrical wings 2 to fit into the hemispherical slots at the ends of the 'C' clamps' extenders 4. Fabrication involved welding 3/8 inch rod stock to the end of 1 1/2×3/8 inch bar stock. Welding, versus machining the piece, was selected only for fabrication simplicity.

High strength square head bolts with threads up to their heads were used for the thrust bolts 5. Various thrust bolt lengths from three to four inches were used.

The first thrust bolt 5 used was four inches long. The bent toe rail 14 in FIG. 2 forced this long thrust bolt's 5 initial position back from the thrust bolt housing 6. This position caused the thrust bolt 5 to have to be used only a little above horizontal or it gouged the deck 16. This provided a poor leverage angle against the pressure plate 1 and also addressed the pressure plate 1 at an acute angle. The combination put high stress and bending moment on the thrust bolt 5. The acute angle of the thrust bolt 5 against the pressure plate 1 also put severe rotating stress on the mounting arrangement of the thrust bolt housing 6, described below.

A pivoting thrust bolt housing 6 was used that also served to connect the 'C' plates 3 at that end of the 'C' plates. The housing 6 was a 1 1/2 cube. All the holes in the housing 6 were threaded, whereas the associated holes in the 'C' plates 3 were not. Lock washers were used with the mounting bolts 11 to try and control unwanted housing 6 rotation during thrust bolt 5 use. The lock washers also served as spacers so the two 1 inch long 3/8 inch mounting, pivot control, bolts 11 would give maximum grip and still not interfere with the thrust bolt 5. The 1 inch bolt 11 length came from adding the thickness of the 'C' plate 3 and 1/3 of the housing 6 piece thickness.

Two other separating/connecting pieces 7 and 8 were welded to the two 'C' plates 3 to hold them together. Welding was selected to assemble these two pieces 7 and 8 to the 'C' plates 3, versus bolted fabrication, only for fabrication simplicity.

One of these permanently mounted connectors 7 attached together the ends of the 'C' plate extensions 4. This connecting piece 7 was 1 1/2 inch wide between the extensions, 3/4 inch along the length of the extensions and 3/8 thick, the same height as the hemispherical slots at the end of the extensions 4. The connector 7 was welded into the space between the 'C' plates 3 near the outer end of the extensions 4. The upper corner of this connector 7, near the pressure plate 1, was chamfered to avoid interference with the pressure plate 1 movement.

The second permanently mounted connector 8 was on the hooking side of the 'C' plates 3 and also served as the mounting for the hook 9 and spacer 10 plates. For that reason it was more convenient to make it flush with the inside edges of the 'C' plates. Its 1 1/2 inch width was to match the width of the thrust bolt housing unit 6. The connector's 3/4 inch thickness was adequate and probably over designed for its stress needs. Similar thickness to the 'C' plates, 1/2 inch, should also be adequate.

The hooking side connector 8 extended from the top to the bottom of that side of the 'C' plates 3, which was done more for fabrication convenience than stress needs.

The hook assembly in this example attached to the inside of the hooking end of the 'C' plates 3. The hook assemble comprised a spacer plate 10 and a hook plate 9 connected to the 'C' plate connector 8 at the hooking end of the 'C' plates 3. The assembly was held together and to the 'C' plates 3 with a single one and one half inch 3/8 inch bolt 12. The hook plate 9 in this example was a piece of 1/4 inch 'L' aluminum channel. The hook extended 1/4 inch beyond the inside face of the right angle surface. The larger surface was five inches long, parallel to the hook surface. A 3/8 inch tapped hole, centered in the middle of the five inch length and centered 29/32 inch from the outside corner of the right angle profile, positioned and held the hook exactly where it was needed to be on this particular toe rail profile that needed to be straightened. A 1/4 inch piece of 2×3 1/2 inch aluminum plate served as a successful spacer plate 10. The spacer plate in this example had an unthreaded hole to pass a 3/8 inch bolt 12. The hole was centered along the length. The hole's center was 1/2 inch from the edge of the spacer plate 10.

The single mounting hole in the connector 8 for the hook 9 and spacer 10 plates was unthreaded, centered 7/8 inch from the bottom of the connector 8 and sized to pass a 3/8 inch bolt 12.

The flanges, 14 and 15, in FIG. 2 are in the profile of the SAGA 43 sailboat hull 45, Bayou Baby, aluminum toe rail extrusion that was straightened in this example. The root of the vertical flange 14 was 1/8 inch thick and the flange 14 was 1 5/16 inch high. The horizontal flange 15 was 1/4 inch thick.

Device Test Results, Discoveries and Confirmations:

Six locations were straightened by Rexford Maugans where the toe rail 14 (the vertical flange) had been bent inward during Hurricane Ike in 2008 at Seabrook Marina in Seabrook, Tex. The right angle toe rail 14 had been damaged along the toe rail in lengths from six to 36 inches. The maximum amount the rail 14 had been bent in varied from 10 to 30 degrees. The device straightened the toe rail damage, two to four inches of width at a time. This was the first use of the device. The time required was less than 1 ½ hours to repair all the toe rail bending damage, including time to assemble the device.

It was surprisingly found that the device's tight fit geometry and dimensions still had enough strength to pry the bent toe rail flanges, FIG. 2, back into position and without warping the flange 14 root to lip dimensions out of straight lines. Nor did such flange bending damage the hull-deck connections 17 and 19.

The ½ inch thrust bolt 5, selected for the test device, did surprisingly well and had no problems with either enough strength to straighten the toe rail or with bending the bolt 5 from angular thrust against the pressure plate 1.

The selection of the ½ inch trust bolt 5 and the ½ inch 'C' plate 3 thicknesses surprisingly confirmed the design ratios in table I for repairing damaged boats' aluminum toe rails, FIG. 2. The rails 14 straightened well and no device components broke or warped.

The 1 ½ inch wide pressure plate 1 width turned out to be a surprisingly workable width for repairing boats' toe rails 14 as one worked down the length of a bent toe rail. It was narrow enough that the thrust bolt 5 size and other dimensions selected were strong enough. It was narrow enough to accommodate precision damage repair. It was wide enough to prevent laborious repetition during repair. This was all the more surprising as the edge effects of the flanges beyond the sides of the pressure plate 1 were unknown. However the device turned out to have no problem with the extra bending resistance. It was also surprisingly discovered that working one's way down a damaged toe rail with the device provided precise damage repair with minimum experimentation to determine how much to bend the flange 14 at each step. Again, the geometry and dimensions went together well.

It was discovered that bent toe rails 14 and/or the extension of hull-deck connectors (bolt heads) 19 above the plane of the horizontal flanges 15 caused complications in sizing spacer plates 10 to position the hook assembly on the 'C' plates 3. It was discovered, that for exact positioning of pressure plates 1 in the toe rail flange intersections, spacer plates 10 need to be thinner when first starting to straighten severely bent toe rails 14 and gradually replaced with thicker spacers 10 as the flange 14 is straightened.

It was further discovered that as the thrust bolt 5 first applied force the device surprisingly first pushed the bottom of the pressure plate 1 into the flange intersection. Continued application of thrust bolt 5 force straightened the toe rail damage smoothly and precisely. This action alleviated the need for exact positioning of the bottom of the pressure plate 1 prior to applying straightening force in this example. This simplified the use of the device as less spacer plate 10 changes were needed while the bent flanges 14 were pried from bent to straight.

The location of the thrust bolt 5 thrust turned out to be a key to the surprising results above with the pressure plate 1 automatically positioning itself in the extrusion flange intersection. The thrust needs to be directed towards a point below the lip of the flange 14, being pried apart. The location of the thrust bolt housing 6 at the bottom of that end of the 'C' plates 3 greatly facilitated that.

The low location on the 'C' plates of the thrust bolt housing 6 raised another issue, how to get a strong angle of thrust on the pressure plate 1 without collateral damage to the fiberglass boat deck 16 from the back, the head, of the bolt 5. It turned out the pivoting thrust bolt housing 6 to optimize thrust also gave an opportunity to avoid interference with the deck. The surprising results were straightened toe rail 14 damage without deck damage 16.

High strength square head bolts 5 were found to provide adequate strength. Using various thrust bolt 5 lengths from three to four inches, as the flange 14 is opened up, was found to help with optimizing thrust angle and avoidance of interference with the boat's deck 16. The threads that go all the way to the head and the small size of the head of the thrust bolts 5 used also facilitated the issue of optimizing thrust angle and avoidance of interference with the boats' decks 16.

The desirable feature of the pivoting thrust bolt housing 6 was also a potential two edged sword. It turns out the angular thrust of the thrust bolt 5 against the pressure plate 1 fed back serious stress to undesirably rotate the thrust bolt housing 6. The design concept of squeezing the housing 6 between the 'C' plates 3, the size of the mounting bolts 11 selected and/or the lock washers surprisingly provided enough rotating resistance that the housing 6 only rotated when adjusted with wrenches.

The dual 'C' plate 3 structure surprisingly proved the extra pressure 1 plate length for a handle was unnecessary to prevent device rotation with the particular boat toe rails that were straightened in this example. However the handle still proved useful during assembly of the device around the bent toe rail segments. The pressure plate 1 was a separate piece and the handle helped control awkwardness with multiple pieces while working over water on the edge of the boat. No parts had to be replaced.

It was discovered that the long hooking plate 9 length worked well in the hook assembly by spreading the load enough to avoid any damage to a delicate aluminum slot on the outside of the toe rail extrusion on this particular boat.

Several situations arose where the device had to be moved or the hooking assembly adjusted. The device design features gave surprising ease in doing so.

The simplicity of assembling the hook assembly with a single bolt 12 was most desirable. The desirability extended to having an easier time aligning the device and in loosening the unit to slide it down the toe rail to straighten more bent spots by degrees. The resultant control of the toe rail angle changes was discovered to give excellent results in short periods of time.

The bolt 12 was likely larger than needed to hold the hook assembly together, but the size was selected to be consistent with the bolts 11 holding the pivoting thrust bolt housing 6. This proved surprisingly useful as only one wrench was needed to adjust both the thrust bolt pivot point and to assemble the hook assembly.

The location of the hooking plate 9 mounting hole in the 'C' plates' connector piece 8 worked well to give some room for excess threads to extend beyond the hook plate and into the relief that often exists below the lip of the vertical flanges of boat toe rails.

The gap between the end of the extensions 4 and the inside surface of the hook plate side of the 'C' plates 3 was 1 3/16 inch and proved adequate to provide room for use of multiple hook 9 and spacer 10 arrangements for multiple toe rail profile designs.

Example 2

To determine how broadly applicable the invention was, a second boat damaged in the same hurricane, a Beneteau First 42, was selected to use the test device in Example 1 to repair different toe rail damage, on a different toe rail profile, FIG. 8, and with a different device operator, Ken Weatherford. The toe rail profile used in this example is shown in the diagram FIG. 8. One profile difference was that the thickness of example 2's bent section 14 was greater than the first example, 3/16 versus 1/8 inch. Another difference was the longer flange 14 height, 1 15/16 versus 1 5/16 inch, FIGS. 7 and 8.

A second profile difference was a different shape that predictably needed different hook plate positioning. The design of the device to provide easy hook plate repositioning was demonstrated as a new hook plate 9 and spacer 10 were fabricated in less than an hour on the dock with aluminum stock, a drill and a tap.

Example 2 surprisingly confirmed how a reasonably small collection of hook 9 and spacer 10 plates with a range of predrilled/pretapped locator holes allowed one to so easily adjust the unit to fit most boats in less than five minutes.

Example 2's boat's toe rail damage was at two locations, one about 24 inches long and the other about 12 inches long, both up to about fifteen degrees inward. The device successfully straightened the damaged toe railing in example 2, as in example 1 and confirmed the success of the dimensions selected for the device as a generic tool to repair multiple boats' variations in bent aluminum toe rails 14.

It was discovered that the stresses for bending the 3/16 inch thick flange 14 were such that the thrust bolt threads were damaged where they contacted the angled pressure plate 1. This prohibited retraction and replacement of the thrust bolt 5 with a different one, as needed for another profile. Grinding down the threads and rounding the end of the bolt 5 resolved the thread problem as well as eliminated the thrust bolt 5 cutting into the surface of the pressure plate 1.

The force needed to straighten the thicker flange 14, FIG. 8, was too great to exert with a normal ½ inch combination wrench. A large crescent wrench and significant operator force was needed, but the device held up surprisingly well: no thrust bolt 5 bending, unwanted thrust bolt housing 6 movement, no damage under the hook plate 9, etc. The only exception was the thread damage, described above, and that was resolved by grinding down/rounding the thread end of the thrust bolt 5.

What is claimed is:

1. A mechanical device to pry apart two intersecting flanges (A and B), with lips, root thicknesses and with a fillet radius, in a profile, the device comprising:

at least one 'C' shaped plate to surround one of the flanges (A), with a hook member with a moving action behind flange (A), a thrust bolt mounted opposite the hooking member, a C shaped plate extension of the 'C' clamp structure that extends below the thrust bolt and substantially parallel to said flange (B):

a pressure plate having a top and a bottom with a thickness being pivotally connected with the extension and pivoting in a same plane as the extension, that pivots in the flange intersection to pry one said flange (A) apart from the flange (B) under the extension(s) when said thrust bolt force is applied to the pressure plate.

2. The device of claim 1, wherein at least one wing at the bottom of the pressure plate is captured by at least one slot in the end of the 'C' plate said extension(s).

3. The device of claim 1, wherein at least one wing at the bottom of the pressure plate is captured by a cylindrical hole in the end of at least one of the 'C' plate said extension(s).

4. The device of claim 1, wherein the pressure plate has a range of various thicknesses.

5. The device of claim 1, wherein the pressure plate has a thickness that is equal to 1.1 times the thickness of the root of the flange to be pried apart or two to four times the radius of the filet at the intersection of the flanges to be pried apart, whichever is larger.

6. The device of claim 1, wherein the 'C' plate extension(s) taper down to a height that is the same as the pressure plate thickness.

7. The device of claim 1, wherein the 'C' plate(s) extension(s) extend up to root of flange (A) to within a distance no more than quadruple the flanges' (A and B) fillet radius.

8. The device of claim 1, wherein the device is comprised of two 'C' plates and the pressure plate fits between said two C plates.

9. The device of claim 1, wherein the thrust bolt is further comprised of a housing which pivotably moves said thrust bolt about adjustable bolts.

10. The device of claim 1, wherein the thrust bolt is in a housing that is a pivoting piece to allow different thrust angles against the pressure plate.

11. The device of claim 1, wherein a hydraulically driven rod is substituted for the thrust bolt.

12. The device of claim 1, wherein a pneumatically driven rod is substituted for the thrust bolt.

13. The device of claim 1, wherein a lever driven rod is substituted for the thrust bolt.

14. The device of claim 1, wherein the hooking action behind flange (A) of said hooking member is modified with adjustable hook plates to avoid profile damage and to allow for different profile geometries.

15. The device of claim 1, wherein the hooking action behind said flange (A) is tightened by at least one bolt.

16. The device of claim 1, wherein the hooking action behind said flange (A) of said hooking member is modified with an adjustable replacement spacer to avoid profile damage and to allow for different profile geometries.

* * * * *